US012727617B2

(12) United States Patent
Tambo et al.

(10) Patent No.: US 12,727,617 B2
(45) Date of Patent: Sep. 8, 2026

(54) CARTRIDGE FOR FLAVOR INHALER AND FLAVOR INHALER

(71) Applicant: Japan Tobacco Inc., Tokyo (JP)

(72) Inventors: Hitoshi Tambo, Tokyo (JP); Manabu Yamada, Tokyo (JP); Masami Kawabe, Tokyo (JP); Toshiki Kudo, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 850 days.

(21) Appl. No.: 18/070,801

(22) Filed: Nov. 29, 2022

(65) Prior Publication Data

US 2023/0087525 A1 Mar. 23, 2023

Related U.S. Application Data

(63) Continuation of application No. PCT/JP2021/028228, filed on Jul. 30, 2021.

(30) Foreign Application Priority Data

Jul. 30, 2020 (WO) ..... PCT/JP2020/029301

(51) Int. Cl.
*A24F 40/42* (2020.01)

(52) U.S. Cl.
CPC ..... *A24F 40/42* (2020.01)

(58) Field of Classification Search
None
See application file for complete search history.

(56) References Cited

U.S. PATENT DOCUMENTS 4,219,060 A * 8/1980 Hasegawa ..... B27D 1/005 144/213
4,924,883 A * 5/1990 Perfetti ..... A24D 1/22 131/335

(Continued)

FOREIGN PATENT DOCUMENTS

CN 105534097 A 5/2016
EP 2907397 A1 * 8/2015 ..... A61M 11/04

(Continued)

OTHER PUBLICATIONS

Extended European Search Report for European Application No. 21849964.8, dated Sep. 2, 2024.

(Continued)

*Primary Examiner* — Thor S Campbell
(74) *Attorney, Agent, or Firm* — Birch, Stewart, Kolasch & Birch, LLP

(57) ABSTRACT

Provided are a cartridge and a flavor inhaler with new structures. A flavor inhaler cartridge includes: a raw material portion that is heated and thereby generates aerosols; and a case that accommodates the raw material portion therein. The case includes a first wall, a second wall that faces the first wall, a pair of connecting walls that connect the first wall to the second wall, a first end surface that is provided with a first opening defined by the first wall, the second wall, and the pair of connecting walls, and a second end surface that faces the first end surface portion. The pair of connecting walls include, on surfaces facing inside of the case, a plurality of half-cuts or debosses extending between the first end surface and the second end surface, and are folded along the plurality of half-cuts or debosses.

15 Claims, 12 Drawing Sheets

(56) References Cited

U.S. PATENT DOCUMENTS

| | | | | | |
|---|---|---|---|---|---|
| 4,955,397 | A * | 9/1990 | Johnson | A24D 1/22 | 131/194 |
| 5,327,915 | A * | 7/1994 | Porenski | A24D 1/22 | 131/194 |
| 8,119,891 | B2 * | 2/2012 | Ryan | B27H 1/00 | 84/291 |
| 10,039,321 | B2 * | 8/2018 | Verleur | A24F 40/50 | |
| 10,219,548 | B2 * | 3/2019 | Robinson | A24B 15/12 | |
| 10,621,961 | B1 * | 4/2020 | Weld | G10D 13/02 | |
| 11,672,279 | B2 * | 6/2023 | Egoyants | A24F 40/46 | 131/329 |
| 11,825,870 | B2 * | 11/2023 | Blandino | H05B 6/105 | |
| 2008/0197043 | A1 * | 8/2008 | Freeze | B65D 5/503 | 206/538 |
| 2016/0001948 | A1 | 1/2016 | Collins et al. | | |
| 2017/0055576 | A1 * | 3/2017 | Beeson | A24D 1/02 | |
| 2017/0057688 | A1 * | 3/2017 | Patwardhan | B65D 5/02 | |
| 2018/0105314 | A1 * | 4/2018 | Jones | B65D 5/4266 | |
| 2018/0220711 | A1 | 8/2018 | Suzuki et al. | | |
| 2020/0120981 | A1 * | 4/2020 | Yamada | A24F 40/46 | |
| 2021/0090529 | A1 * | 3/2021 | Greene | G10D 1/08 | |
| 2025/0160393 | A1 | 5/2025 | Blandino et al. | | |
| 2025/0241281 | A1 * | 7/2025 | Keating | A01K 85/18 | |

FOREIGN PATENT DOCUMENTS

| | | | | | |
|---|---|---|---|---|---|
| JP | 5737771 | B2 * | 6/2015 | A24F 42/60 | |
| KR | 10-2020-0000500 | A | 1/2020 | | |
| TW | I605764 | B * | 11/2017 | A24B 13/00 | |
| TW | 202203790 | A * | 2/2022 | A24F 40/42 | |
| WO | WO-2010095659 | A1 * | 8/2010 | A24B 15/285 | |
| WO | WO-2014021310 | A1 * | 2/2014 | A61M 11/04 | |
| WO | WO-2014038484 | A1 * | 3/2014 | B65D 73/0021 | |
| WO | WO-2018235241 | A1 * | 12/2018 | A24F 40/20 | |
| WO | WO 2019/162497 | A1 | 8/2019 | | |
| WO | WO-2019162498 | A1 * | 8/2019 | A24D 1/20 | |
| WO | WO 2022/223712 | A1 | 10/2022 | | |

OTHER PUBLICATIONS

Russian Office Action and Search Report for Russian Application No. 2022128173/03(061892), dated May 25, 2023, with English translation.

International Search Report (PCT/ISA/210), issued in PCT/JP2021/028228, dated Sep. 21, 2021.

European Communication pursuant to Article 94(3) EPC for European Application No. 21 849 964.8, dated Aug. 26, 2025.

* cited by examiner

CARTRIDGE FOR FLAVOR INHALER AND FLAVOR INHALER

CROSS REFERENCE TO RELATED APPLICATIONS

The present application is a continuation application of International Application No. PCT/JP2021/028228, filed on Jul. 30, 2021, which claims priority under 35 U.S.C. 119(a) to Patent Application No. PCT/JP2020/029301, filed in Japan on Jul. 30, 2020, all of which are hereby expressly incorporated by reference into the present application.

TECHNICAL FIELD

The present invention relates to a flavor inhaler cartridge and a flavor inhaler.

BACKGROUND ART

In the related art, flavor inhalers for inhaling flavors and the like without burning any materials are known. As such a flavor inhaler, a smoking material heating apparatus that forms aerosols by heating a smoking material made of tobacco containing a volatile component, for example, is known. As such a smoking material, a consumable supply including a slab-shaped tobacco, a spacer, and a filter is known (see PTL 1).

CITATION LIST

Patent Literature

PTL 1: International Publication No. WO 2019/162497

SUMMARY OF INVENTION

Technical Problem

An object of the present invention is to provide a cartridge and a flavor inhaler with new structures.

Solution to Problem

According to a mode of the present invention, there is provided a flavor inhaler cartridge. The flavor inhaler cartridge includes: a raw material portion that is heated and thereby generates aerosols; and a case that accommodates the raw material portion therein. The case includes a first wall, a second wall that faces the first wall, a pair of connecting walls that connect the first wall to the second wall, a first end surface that is provided with a first opening defined by the first wall, the second wall, and the pair of connecting walls, and a second end surface that faces the first end surface portion. The pair of connecting walls include, on surfaces facing inside of the case, a plurality of half-cuts or debosses extending between the first end surface and the second end surface.

According to another mode of the present invention, there is provided a flavor inhaler. The flavor inhaler includes: a heating portion that is configured to heat the raw material portion of the above flavor inhaler cartridge; and a battery that is configured to supply electric power to the heating portion.

DESCRIPTION OF EMBODIMENTS

Figure 1:
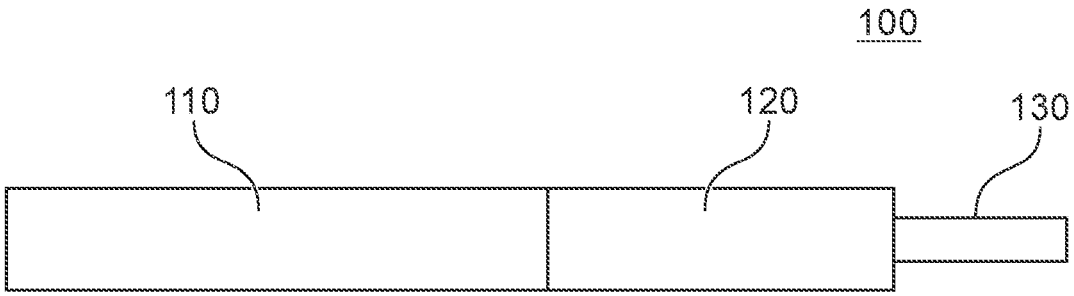
FIG. 1 is a schematic side view of a flavor inhaler according to the present embodiment.

Hereinafter, embodiments of the present invention will be described with reference to the drawings. The same reference signs will be applied to the same or corresponding components in the drawings which will be described below, and repeated description will be omitted.

FIG. 1 is a schematic side view of a flavor inhaler according to the present embodiment. A flavor inhaler 100 according to the present embodiment is configured to generate aerosols including a flavor by heating an aerosol source and a flavor source. As illustrated in the drawing, the flavor inhaler 100 includes a first housing 110, a second housing 120, and a mouthpiece 130. The first housing 110 and the second housing 120 can be configured to be attachable to and detachable from each other. Here, "attachable to and detachable from" includes not only a case in which the first housing 110 and the second housing 120 are completely separated from each other but also a case in which the first housing 110 and the second housing 120 are partially connected with a hinge or the like as will be described later. The mouthpiece 130 can be connected to one end of the second housing 120 in an attachable/detachable manner or can be formed integrally with the second housing 120.

Figure 2:
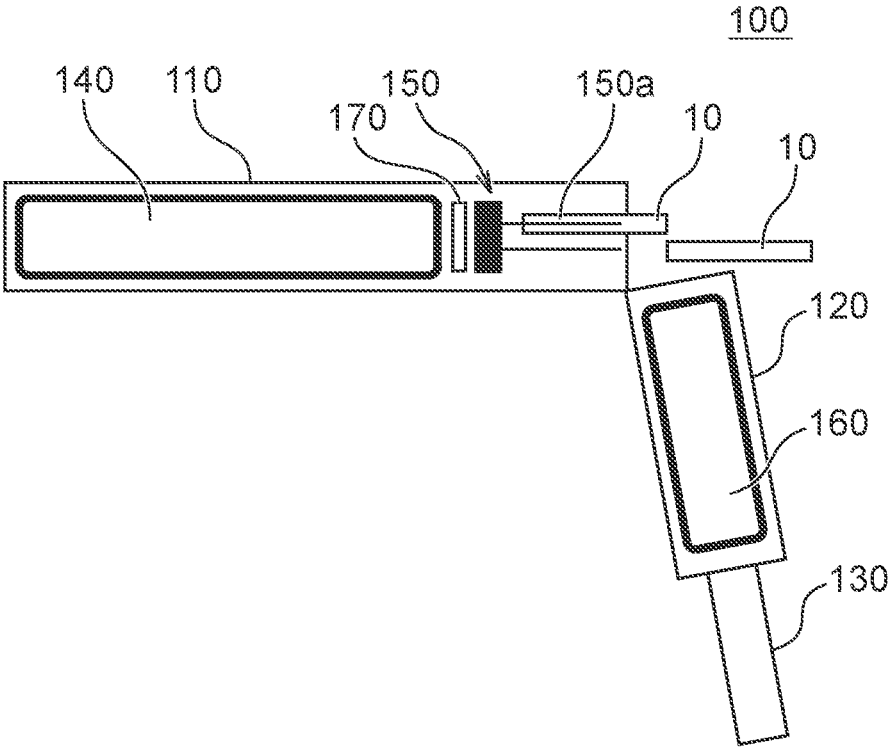
FIG. 2 is a schematic view of an example of the flavor inhaler.

FIG. 2 is a schematic view of an example of the flavor inhaler 100. As illustrated in the drawing, the flavor inhaler 100 includes a battery 140 that is disposed inside the first housing 110, a heating portion 150, a control circuit 170, and a cooling portion 160 that is disposed inside the second housing 120. As illustrated in the drawing, the first housing 110 and the second housing 120 are rotatably connected to each other with a hinge. The first housing 110 and the second housing 120 may be connected to each other such that the first housing 110 and the second housing 120 can be completely separated from each other, through snap-fit, screwing, or the like. It is thus possible to easily clean the cooling portion 160, the mouthpiece 130, and the heating portion 150 by the first housing 110 and the second housing 120 being completely separated from each other.

The battery 140 is configured to supply electric power to the heating portion 150, the control circuit 170, and the like. For example, the battery 140 is a lithium ion battery. The battery 140 may be able to be charged with an external power source. The cooling portion 160 is configured to cool aerosols generated from a cartridge 10. The cooling portion 160 can be a space where aerosols passing therethrough are naturally cooled, for example. Alternatively, one or more materials selected from a group consisting of polyethylene, polypropylene, polyvinyl chloride, polyethylene terephthalate, a polylactic acid, cellulose acetate, and an aluminum foil may be disposed in or may fill the cooling portion 160. It is possible to more efficiently cool the aerosols by these materials being disposed in or filling the cooling portion 160.

In the illustrated example, the heating portion 150 includes heating blades 150*a* that are inserted into the cartridge 10. In other words, the heating portion 150 is an internal heating-type heater that heats the cartridge 10 from the inside thereof. The heating blades 150*a* include substrates made of a resin, for example, and heating tracks formed on surfaces of the substrates and can have a thickness of about 0.5 mm, for example. Also, in the illustrated example, the heating portion 150 includes two heating blades 150*a*. In the flavor inhaler 100, one cartridge 10 may be attached to any of the heating blades 150*a*, or two cartridges 10 may be attached to the heating blades 150*a*, respectively. It is thus possible to adjust the amount of aerosols generated from the cartridge 10. The flavor inhaler 100 may include one heating blade 150*a* or may include two or more heating blades 150*a*. The heating portion 150 is configured to heat the cartridge 10 to a temperature of equal to or greater than 200° C. and equal to or less than 300° C., for example.

The control circuit 170 is configured of a CPU, a memory, and the like and controls operations of the flavor inhaler 100. For example, the control circuit 170 starts heating of the cartridge 10 in response to a user's operation on an input device such as a press button or a slide-type switch, which is not illustrated, and ends the heating of the cartridge 10 after a specific period of time elapses. The control circuit 170 may end the heating of the cartridge 10 even before the specific period of time elapses from the start of the heating of the cartridge 10 in a case in which the number of times the user performs a puffing action exceeds a specific value. For example, the puffing action is detected by a sensor, which is not illustrated.

Alternatively, the control circuit 170 may start the heating of the cartridge 10 in response to a start of the puffing action and end the heating of the cartridge 10 in response to an end of the puffing action. The control circuit 170 may end the heating of the cartridge 10 even before the puffing action is ended, in a case in which a specific period of time elapses after the start of the puffing action. In the illustrated example, the control circuit 170 is disposed between the battery 140 and the heating portion 150 and curbs heat transmission from the heating portion 150 to the battery 140.

The cartridge 10 is heated by the heating portion 150 and thus generates vapor and aerosols of an aerosol source or a flavor source. The vapor and the aerosols generated in the cartridge 10 are cooled by passing through the cooling portion 160 and reach the inside of the user's mouth through the mouthpiece 130 via suctioning of the user. The vapor generated in the cartridge 10 is cooled by the cooling portion 160 and can be atomized into aerosols. In the present embodiment, the cartridge 10 has a thin plate shape or a card shape. The cartridge 10 is disposed such that a part of the cartridge 10 projects from the first housing 110 in a state in which the heating blade 150*a* of the heating portion 150 is inserted into the cartridge 10. It is thus possible for the user to easily detach the cartridge 10 after use from the heating blade 150*a*.

Figure 3:
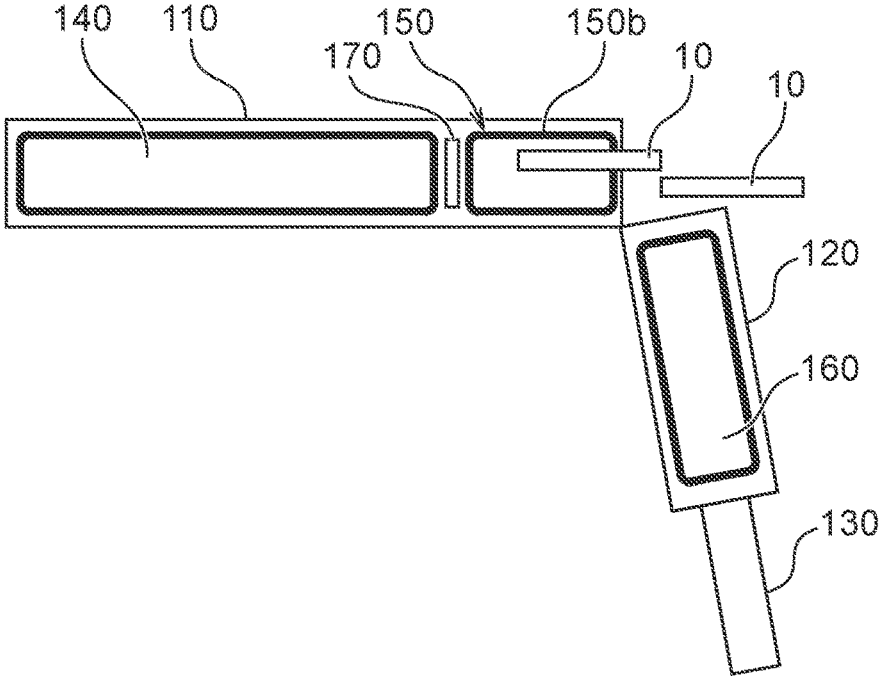
FIG. 3 is a schematic view of another example of the flavor inhaler.

FIG. 3 is a schematic view of another example of the flavor inhaler 100. The flavor inhaler 100 illustrated in FIG. 3 is different from the flavor inhaler 100 illustrated in FIG. 2 in the configuration of the heating portion 150. Specifically, the heating portion 150 includes an induction coil 150*b* for induction-heating a susceptor. The susceptor may be provided in the flavor inhaler 100 or may be provided in the cartridge 10. For example, the flavor inhaler 100 may include the susceptor to be inserted into the cartridge 10 when the cartridge 10 is disposed in the heating portion 150. Alternatively, the cartridge 10 may include a metal material that is induction-heated by the induction coil 150*b*. Note that the flavor inhaler 100 illustrated in FIG. 3 may include, between the heating portion 150 and the control circuit 170, an electromagnetic shield (not illustrated) that curbs an electromagnetic wave generated by the induction coil 150*b* from reaching the control circuit 170.

Figure 4:
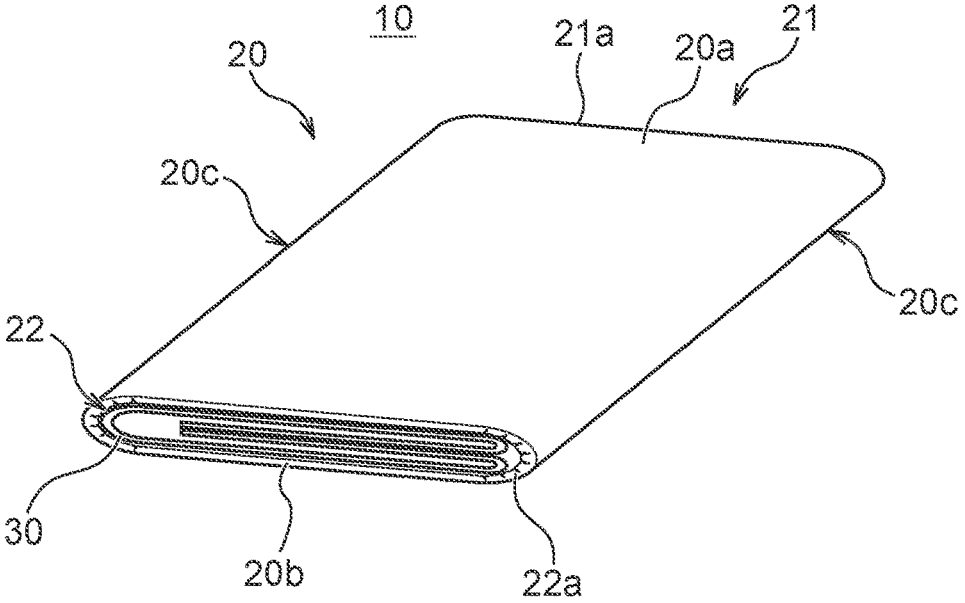
FIG. 4 is a perspective view of a cartridge.

Next, details of the cartridge 10 will be described. FIG. 4 is a perspective view of the cartridge 10. The cartridge 10 includes a raw material portion 30 that is heated and thereby generates aerosols and a case 20 that accommodates the raw material portion 30 therein. The cartridge 10 illustrated in FIG. 4 does not include a mouthpiece or a filter and a cooling portion and includes only the raw material portion 30. In other words, since the cartridge 10 has a simple configuration, it is easy to continuously manufacture the cartridge 10, and it is possible to relatively reduce the weight of waste of the cartridge 10 after use. Also, since there is no need to provide a cooling function and a filter function to the cartridge 10, a degree of freedom in designing the cooling portion 160 and the mouthpiece 130 (or a filter) in the flavor inhaler 100 is improved. Specifically, it is possible to easily improve the cooling function by applying a work to increase the surface area to the cooling portion 160 of the flavor inhaler 100 in order to promote heat dissipation.

The case 20 has a thin substantially tubular shape and includes a first wall 20*a*, a second wall 20*b*, and a pair of connecting walls 20*c*. The first wall 20*a* is a wall having the largest plane of the case 20. The second wall 20*b* faces the first wall 20*a*. The pair of connecting walls 20*c* connect the first wall 20*a* to the second wall 20*b*. Specifically, one of the connecting walls 20*c* extends between one end of the first wall 20*a* and one end of the second wall 20*b*, and the other one of the connecting walls 20*c* extends between the other end of the first wall 20*a* and the other end of the second wall 20*b*. Therefore, the substantially tubular case 20 is formed by the first wall 20*a*, the second wall 20*b*, and the pair of connecting walls 20*c*, and one or more air flow paths through which the aerosols pass as will be described later are provided inside the case 20.

Also, the case 20 includes a first opening 21, a second opening 22 that faces the first opening 21, a first end surface 21*a* that is provided with the first opening 21, and a second end surface 22*a* that is provided with the second opening 22. The first opening 21 and the second opening 22 are defined by the first wall 20*a*, the second wall 20*b*, and the pair of connecting walls 20*c*. The heating blade 150*a* of the heating portion 150 or the susceptor of the flavor inhaler 100 described above can be inserted into the second opening 22. The aerosols directed from the raw material portion 30 to the cooling portion 160 can pass through the first opening 21. The first opening 21 and the second opening 22 can have substantially the same opening shapes.

The thickness of the case 20 (the length between the outer side surface of the first wall 20*a* and the outer side surface of the second wall 20*b*) can ranges from about 1.5 mm to about 4.0 mm, for example. The length of the case 20 (the length between the first end surface 21*a* and the second end surface 22*a*) ranges from about 18 mm to 25 mm, for example. The width of the case 20 (the length that is orthogonal to the thickness direction and the length direction) is, for example, about 12 mm. The case 20 can be formed of a predetermined cardboard, for example. Specifically, the case 20 can be formed of a paper with a paper weight of equal to or greater than 100 $g/m^2$ and equal to or less than 300 $g/m^2$, for example.

It is possible to remove the cartridge 10 from the heating portion 150 without the user directly touching the raw material portion 30 at a high temperature after use, by the raw material portion 30 being accommodated in the case 20. Also, it is possible to maintain the shape of the raw material portion 30, which is relatively easily deformed, by the raw material portion 30 being accommodated in the case 20, and the size of a first clearance 33 or a second clearance 34 included in the raw material portion 30, which will be described later, is easily maintained to be constant. Furthermore, it is possible to absorb a part of vapor or aerosols generated from the raw material portion 30 by the case 20 being formed of a paper and to curb condensation of the vapor or the aerosols inside the flavor inhaler 100.

A metal foil such as aluminum may be provided on the inner surface of the case 20. In this manner, it is possible to curb heat dissipation through heat emission of the heating portion 150 and the raw material portion 30 heated by the heating portion 150 and to efficiently heat the raw material portion 30.

Figure 5:
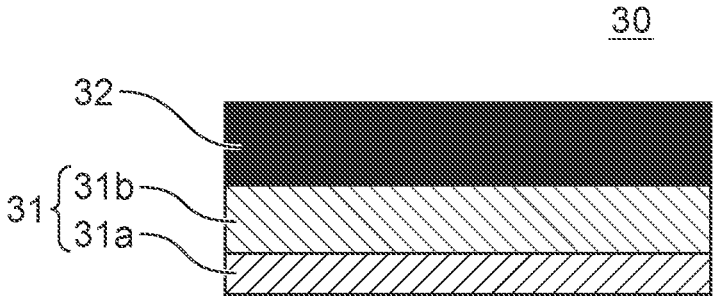
FIG. 5 is an enlarged sectional view of a part of a raw material portion.

The raw material portion 30 according to the present embodiment includes a sheet including folding lines. FIG. 5 is an enlarged sectional view of a part of the raw material portion 30. As illustrated in the drawing, the raw material portion 30 includes a base material layer 31 and a raw material layer 32. The base material layer 31 and the raw material layer 32 are laminated. In the present embodiment, the base material layer 31 is a metal attached paper formed by a metal layer 31*a* of aluminum, stainless steel, or the like and a paper layer 31*b* being attached to each other. It is possible to efficiently transmit heat of the heating blade 150*a* of the heating portion 150 to the raw material layer 32 by the base material layer 31 including the metal layer 31*a*. Also, in the case in which the base material layer 31 includes the metal layer 31*a*, it is also possible to use the metal layer 31*a* as a susceptor. In one embodiment, the base material layer 31 may be a paper that does not include the metal layer 31*a*. Specifically, the base material layer 31 may be configured only of a paper layer of a pulp paper or the like. The thickness of the metal layer 31*a* is equal to or greater than 5 μm and equal to or less than 30 μm, for example, in a case in which the metal is aluminum, and if the amount of metal to be used is reduced, and heat transmission is taken into consideration, the preferable thickness is equal to or greater than 5 μm and equal to or less than 15 μm, and specifically, it can be about 10 μm.

The raw material layer 32 is not attached to the base material layer 31 via an adhesive such as glue but is formed integrally with the base material layer 31 by being applied to the base material layer 31. Although the raw material layer 32 may be attached to the base material layer 31 via an adhesive such as glue, attachment with no intervention of any adhesive is preferably adopted in terms of a smoke taste and simplification of a process of manufacturing the raw material portion 30. The raw material layer 32 can be a tobacco sheet including, for example, tobacco (corresponding to an example of a flavor source), a polyhydric alcohol (corresponding to an example of an aerosol source), and the like. The polyhydric alcohol can include glycerin, propylene glycol, sorbitol, xylitol, and erythritol. One of these polyhydric alcohols may be used alone, or two or more kinds thereof may be used in combination, for the raw material layer 32. Specifically, the raw material layer 32 can be formed by mixing a binder into powder tobacco and a polyhydric alcohol, applying the mixture to the paper layer 31*b* of the base material layer 31, and then evaporating a part of moisture thereof. As the binder, it is possible to use, for example, guar gam, xanthan gum, carboxy methyl cellulose (CMC), a sodium salt of carboxy methyl cellulose (CMC-Na), pullulan and hydroxypropyl cellulose (HPC), methyl cellulose, or hydroxyl methyl cellulose.

Also, pulp may be added to the raw material layer 32. The pulp can improve strength of the raw material layer 32. However, pulp may not be added to the raw material layer 32 when there is no need to improve the strength of the raw material layer 32, such as a case in which the raw material portion 30 includes the base material layer 31 as in the present embodiment. In a case in which pulp is not used, the proportion of the tobacco in the raw material layer 32 increases by the corresponding amount, and an improvement in smoke tastes is thus expected.

Although the binder can be added to the raw material layer 32 for the purpose of controlling appropriate application of the raw materials, the binder may not be added. The percentage by weight of the binder that can be added to the raw material layer 32 is preferably equal to or greater than 0% and equal to or less than 60% and is more preferably equal to or greater than 0% and equal to or less than 10% with respect to the weight of the raw material layer 32, for example.

The raw material layer 32 can have blending rates (percentages by weight) of 5% to 40% of polyhydric alcohol, 50% to 90% of tobacco, 0% to 10% of binder, and 0% to 10% of pulp, for example. Also, an acid such as lactic acid, palmitic acid, or benzoic acid may be added to the raw material layer 32.

Also, the raw material portion 30 preferably has a tensile strength of equal to or greater than 3.0 N/15 mm, more preferably has a tensile strength of equal to or greater than 5.0 N/15 mm, and further preferably has a tensile strength of equal to or greater than 10 N/15 mm in terms of the manufacturing. Note that the tensile strength of the raw material portion 30 can be measured by performing a dry tensile strength test (ISO 1924-2) on a test piece of 250 mm×15 mm. It is possible to easily fold the raw material portion 30 when the raw material portion 30 is manufactured as will be described later and to curb breaking of the raw material portion 30, by the raw material portion 30 having the above tensile strength.

Even if the base material layer 31 does not include the paper layer 31*b*, it is possible to select types and blending rates of raw materials such that the raw material layer 32 can be applied to the metal layer 31*a* of the base material layer 31. On the other hand, it is possible to improve fixability of the raw material layer 32 to the base material layer 31 by the base material layer 31 including the paper layer 31*b* as described above. Specifically, appropriate application and adhesiveness of the raw material layer 32 to the base material layer 31 can be improved by the base material layer 31 including the paper layer 31*b*. The reason is considered to be because affinity between the paper layer 31*b* and the raw materials is high and adhesiveness is enhanced by the raw materials being entangled with minute irregularity of the pulp on the surface of the paper layer 31*b*. Also, the paper layer 31*b* functions as a cushion material at the time of drying and can secure flexibility of the raw material portion 30 including the raw material layer 32 and the base material layer 31.

Also, the raw material layer 32 may be a non-tobacco sheet including an aerosol source, for example, as well as the aforementioned tobacco sheet. The non-tobacco sheet means non-tobacco raw materials formed into a sheet shape and may contain a tobacco raw material. Specifically, the raw material layer 32 can include non-tobacco fiber such as pulp fiber or a non-woven fabric and an aerosol source. The non-tobacco fiber used for the non-tobacco sheet may include non-pulp fiber. The non-pulp fiber is fiber other than pulp fiber. The pulp fiber is a group of cellulose fiber extracted from a plant such as a wood material and is typically used as a raw material for paper. Examples of the pulp fiber include waste paper pulp, chemical pulp, mechanical pulp, and the like.

The non-tobacco sheet may include a binder. The binder is an adhesive for binding the fiber and the like. As the binder, a binder known in the field can be used. The non-tobacco sheet may include an emulsifier. The emulsifier enhances affinity between a lipophilic aerosol generating base material and hydrophilic non-valve fiber. A known emulsifier can be used, and examples thereof include an emulsifier with an HLB value of 8 to 18.

The aerosol source is a material that is gasified through heating, is then cooled, and thereby generates aerosols or a material that generates aerosols through atomization. A known aerosol source can be used, and examples thereof include polyhydric alcohols such as glycerin and propylene glycol (PG), triethyl citrate (TEC), and triacetin. The aerosol source can also be added to the raw material layer 32 of the aforementioned tobacco sheet.

The non-tobacco sheet may include a flavor generating base material. The flavor generating base material is a material that provides a flavor and a smoke taste and is preferably a tobacco material. Specific examples of the tobacco material include chopped dried tobacco leaves, ground leaf tobacco, and a tobacco extract (an extract using water, an organic solvent, or a mixture thereof). The ground leaf tobacco means particles obtained by grinding leaf tobacco. An average particle diameter of the ground leaf tobacco can be, for example, 30 to 120 μm. The grinding can be performed using a known grinding machine and may be dry grinding or wet grinding. Therefore, the ground leaf tobacco is also referred to as leaf tobacco particles. In the present embodiment, the average particle diameter is obtained by a laser diffraction scattering method, and specifically, it is measured using a laser diffraction-type particle diameter distribution measurement apparatus (for example, LA-950 available from Horiba Ltd.). Also, the type of tobacco is not limited, and it is possible to use a yellow cultivar, a Burley cultivar, an orient cultivar, a local cultivar, and other cultivars such as *Nicotiana tabacum* breeds and *Nicotiana rustica* breeds. Although the amount of flavor generating base material in the non-tobacco sheet is not particularly limited, the amount is preferably 1 to 30% by weight and is more preferably 10 to 20% by weight.

The non-tobacco sheet may include a flavoring. The flavoring is a substance that provides a flavor and a taste. The flavoring may be a natural flavoring or a synthetic flavoring. One kind of flavoring may be used, or a mixture of a plurality of types of flavorings may be used, as the flavoring. It is possible to use, as the flavoring, an arbitrary flavoring that is typically used in a smoking product, and specific examples thereof will be described later. The flavoring can be included in the non-tobacco sheet in such an amount that the smoking product can provide a favorable flavor and taste, and for example, the amount thereof is preferably 1 to 30% by weight and is more preferably 10 to 20% by weight in the non-tobacco sheet.

As the flavoring, it is possible to use any flavoring as long as the flavoring is typically used, such as an essential oil, a natural flavoring, or a synthetic flavoring, for example. Also, the flavoring may be a liquid or a solid and may be in any form. Suitable examples of flavor include tobacco extracts and tobacco components, sugar and sugar-based flavors, licorice, cocoa, chocolate, fruit juices and fruits, spices, western liquors, herbs, vanilla, a flavoring selected from flower-based flavors, and combinations thereof. Specific examples include a flavoring selected from isothiocyanates, indole and derivatives thereof, ethers, esters, ketones, fatty acids, aliphatic higher alcohols, aliphatic higher aldehydes, aliphatic higher hydrocarbons, thioethers, thiols, terpene-based hydrocarbons, phenol ethers, phenols, furfural and derivatives thereof, aromatic alcohols, aromatic aldehydes, lactones, and the like or a combination thereof.

It is also possible to use a wide range of flavoring components as described in "Collection of Well-known Prior Arts (flavorings)" (Mar. 14, 2007; issued by Patent Office), "SAISHIN KORYO NO JITEN (popular edition)" (Feb. 25, 2012; edited by Soichi Arai, Akio Kobayashi, Izumi Yajima, Michiaki Kawasaki; Asakura Publishing Co., Ltd.), and "Tobacco Flavoring for Smoking Products" (June 1972, R.J. REYNOLDS TOBACCO COMPANY), for example.

In terms of application of satisfactory smoking taste, examples thereof include acetoanisole, acetophenone, acetylpyrazine, 2-acetylthiazole, alfalfa extract, amyl alcohol, amyl butyrate, trans-anethole, star anise oil, apple juice, Peru Balsam oil, beeswax absolute, benzaldehyde, benzoin resinoid, benzyl alcohol, benzyl benzoate, benzyl phenylacetate, benzyl propionate, 2,3-butanedione, 2-butanol, butyl butyrate, butyric acid, caramel, cardamom oil, carob absolute, β-carotene, carrot juice, L-carvone, β-caryophyllene, cassia oil, cedar wood oil, celery seed oil, chamomile oil, cinnamaldehyde, cinnamic acid, cinnamyl alcohol, cinnamyl cinnamate, citronella oil, DL-citronellol, clary sage extract, cocoa, coffee, cognac oil, coriander oil, cumin aldehyde, davana oil, δ-decalactone, γ-decalactone, decanoic acid, dill herb oil, 3,4-dimethyl-1,2-cyclopentanedione, 4,5-dimethyl-3-hydroxy-2,5-dihydrofuran-2-on, 3,7-dimethyl-6-octenoic acid, 2,3-dimethylpyrazine, 2,5-dimethylpyrazine, 2,6-dimethylpyrazine, 2-ethyl methylbutyrate, ethyl acetate, ethyl butyrate, ethyl hexanoate, ethyl isovalerate, ethyl lactate, ethyl laurate, ethyl levulinate, ethyl maltol, ethyl octanoate, ethyl oleate, ethyl palmitate, ethyl phenylacetate, ethyl propionate, ethyl stearate, ethyl valerate, ethyl vanillin, ethyl vanillin glucoside, 2-ethyl-3,(5 or 6)-dimethylpyrazine, 5-ethyl-3-hydroxy-4-methyl-2(5H)-furanone, 2-ethyl-3-methylpyrazine, eucalyptol, fenugreek absolute, gene absolute, gentian root infusion, geraniol, geranyl acetate, grape juice, guaiacol, guava extract, γ-heptalactone, γ-hexalactone, hexanoic acid, cis-3-hexene-1-ol, hexyl acetate, hexyl alcohol, hexyl phenylacetate, honey, 4-hydroxy-3-pentenoic acid lactone, 4-hydroxy-4-(3-hydroxy-1-butenyl)-3,5,5-trimethyl-2-cyclohexene-1-on, 4-(para-hydroxyphenyl)-2-butanone, 4-hydroxyundecanoic acid sodium, immoltel absolute, β-ionone, isoamyl acetate, isoamyl butyrate, isoamyl phenylacetate, isobutyl acetate, isobutyl phenyl acetate, jasmine absolute, kola nut tincture, labdanum oil, lemon terpeneless oil, glycyrrhiza extract, linalool, linalyl acetate, lovage root oil, maltol, maple syrup, menthol, menthone, acetic acid L-menthyl, paramethoxybenzaldehyde, methyl-2-pyrrolylketone, methyl anthranilate, methyl phenylacetate, methyl salicylate, 4'-methylacetophenone, methylcyclopentenolone, 3-methyl valeic acid, mimosa absolute, molasse, myristic acid, Nellore, nerolidol, γ-nonalactone, nutmeg oil, δ-octalactone, octanal, octanoic acid, orange flower oil, orange oil, orris root oil, palmitic acid, ω-pentadecalactone, peppermint oil, petitgrain Paraguay oil, phenethyl alcohol, phenethyl phenylacetate, phenyl acetic acid, piperonal, plum extract, propenyl guaetol, propyl acetate, 3-propylidene phthalide, prune juice, pyruvic acid, raisin extract, rose oil, rum, sage oil, sandalwood oil, spearmint oil, styrax absolute, marigold oil, tea distillate, α-terpineol, terpinyl acetate, 5,6,7,8-tetrahydroquinoxaline, 1,5,5,9-tetramethyl-13-oxacyclo(8,3,0,0(4,9))tridecane, 2,3,5,6-tetramethylpyrazine, thyme oil, tomato extract, 2-tridecanone, triethyl citrate, 4-(2,6,6-trimethyl-1-cyclohexenyl)2-butene-4-on, 2,6,6-trimethyl-2-cyclohexene-1,4-dion, 4-(2,6,6-trimethyl-1,3-cyclohexadienyl)2-butene-4-on, 2,3,5-trimethylpyrazine, γ-undecalactone, γ-valerolactone, vanilla extract, vanillin, veratraldehyde, violet leaf absolute, citral, mandarin oil, 4-(acetoxymethyl) toluene, 2-methyl-1-butanol, 10-ethyl undecenoate, isoamyl hexanoate, 1-phenyl ethyl acetic acid, lauric acid, 8-mercaptomenthone, sinensal, and hexyl butyrate, and menthol is particularly preferably used. Also, one kind out of these flavorings may be used alone, or two or more kinds thereof may be used together.

The type of the solid flavoring is not particularly limited, and in terms of application of satisfactory smoking taste, examples thereof include a flavoring selected from cocoa powder, carob powder, coriander powder, licorice powder, orange peel powder, herb powder, flower powder, spice powder, tea powder, and the like or a combination thereof.

Also, the non-tobacco sheet may include a refreshing agent or a seasoning. The type of the refreshing agent is not particularly limited, and in terms of application of satisfactory smoking taste, examples thereof include menthol, camphor, isopulegol, cineole, mint oil, peppermint oil, eucalyptus oil, 2-1-menthoxyethanol (COOLACT (registered trademark) 5), 3-1-menthoxypropane-1,2-diol (COOLACT (registered trademark) 10), 1-menthyl-3-hydroxybutyrate (COOLACT (registered trademark) 20), p-menthane-3,8-diol (COOLACT (registered trademark) 38D), N-(2-hydroxy-2-phenylethyl)-2-isopropyl-5,5-dimethylcyclohexane-1-carboxamide (COOLACT (registered trademark) 370), N-(4-(cyanomethyl)phenyl)-2-isopropyl-5,5-dimethylcyclohexanecarboxamide (COOLACT (registered trademark) 400), N-(3-hydroxy-4-methoxyphenyl)-2-isopropyl-5,5-dimethylcyclohexanecarboxamide, N-ethyl-p-menthane-3-carbamide (WS-3), ethyl-2-(p-menthane-3-carboxamide)acetate (WS-5), N-(4-methoxyphenyl)-p-menthanecarboxamide (WS-12), 2-isopropyl-N,2,3-trimethylbutylamide (WS-23), 3-1-menthoxy-2-methylpropane-1,2-diol, 2-1-menthoxyethane-1-ol, 3-1-menthoxypropane-1-ol, 4-1-menthoxybutane-1-ol, menthyl lactate (FEMA3748), menthone glycerin acetal (FrescolatMGA, FEMA3807, FEMA3808), 2-(2-1-menthyloxyethyl)ethanol, menthyl glyoxylate, 2-pyrrolidone-5-menthyl carboxylate, menthyl succinate (FEMA3810), N-(2-(pyridine-2-yl)-ethyl)-3-p-menthane carboxamide (FEMA4549), N-(ethoxycarbonylmethyl)-p-menthane-3-carboxamide, N-(4-cyanomethylphenyl)-p-menthane carboxamide, and N-(4-aminocarbonylphenyl)-p-menthane. A refreshing agent may be used alone, or two or more kinds thereof may be used together.

The type of the seasoning is not particularly limited, and in terms of application of satisfactory smoking taste, examples thereof include sweeteners (sugar (glucose, fructose, isomerized sugar, caramel, and the like), acidulants (organic acids and the like), and other taste components (materials with delicious taste, bitter taste, salty taste and the like). In addition, fat (a wax, a wax material, fatty acids (short-chain, middle-chain, and long-chain fatty acids, and the like)) can be optionally added.

In a case in which a flavoring, a refreshing agent, and a seasoning are contained in shredded tobacco, although the total content thereof is not particularly limited according to an aspect, the total content is typically equal to or greater than 10000 ppm, is preferably equal to or greater than 20000 ppm, is more preferably equal to or greater than 25000 ppm, and is also typically equal to or less than 70000 ppm, is preferably 50000 ppm, is more preferably equal to or less than 40000 ppm, and is further preferably equal to or less than 33000 ppm, in terms of application of a satisfactory smoking taste. Also, the total amount is preferably equal to or greater than 2% by weight, is more preferably equal to or greater than 5% by weight, and is preferably equal to or less than 20% by weight, and is more preferably equal to or less than 10% by weight in another aspect.

Figure 6:
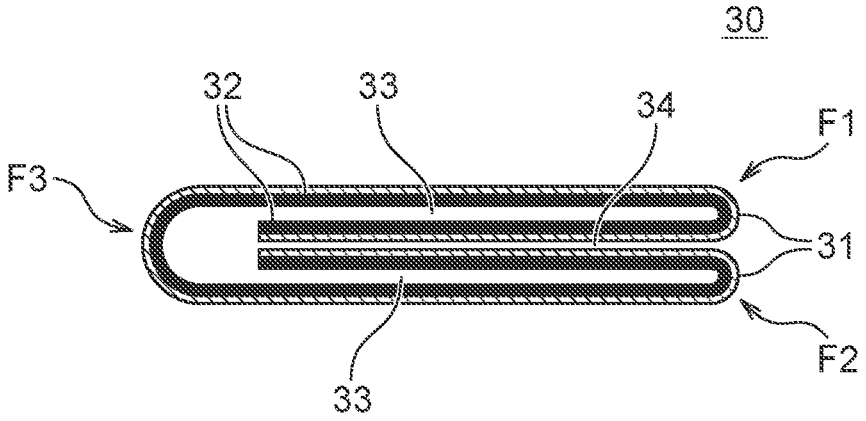
FIG. 6 is a diagram illustrating an example of a section of the raw material portion in a state in which the raw material portion is accommodated in a case.

FIG. 6 is a diagram illustrating an example of a section of the raw material portion 30 in a state in which the raw material portion 30 is accommodated in the case 20. The raw material portion 30 in the illustrated example includes three folding lines F1, F2, and F3. Specifically, the raw material portion 30 is folded along the folding line F1 and the folding line F2 such that the raw material layer 32 faces itself, and is folded along the folding line F3 such that the base material layer 31 faces itself. In this manner, the raw material portion 30 includes first clearances 33 formed by the raw material layer 32 facing itself and a second clearance 34 formed by the base material layer 31 facing itself. In other words, it is possible to form the first clearances 33 and the second clearance 34 without causing complete close contact of the sheet with the repulsive force caused by plastic deformation of the metal layer 31*a* of the base material layer 31 and the repulsive force caused by elastic deformation due to folding of the paper layer 31*b* interacting with each other and keeping a balance therebetween, by folding the raw material portion 30 that is a sheet along the folding lines F1, F2, and F3. Note that even in a case in which the base material layer 31 is formed only of the metal layer 31*a* or the paper layer 31*b*, it is also possible to form the first clearances 33 and the second clearance 34 without causing complete close contact of the sheet due to a force of the metal layer 31*a* maintaining the shape achieved through plastic deformation or a repulsive force caused by elastic deformation due to folding of the paper layer 31*b*. In the illustrated example, the raw material portion 30 includes a pair of first clearances 33, and the second clearance 34 is located between the pair of first clearances 33. In this manner, it is possible to substantially uniformly heat the raw material layer 32 located on both sides of the second clearance 34 with the heating blade 150*a* or the susceptor disposed at the second clearance 34, and as a result, it is possible to uniformize the aerosols generated from the pair of first clearances 33.

Figure 7:
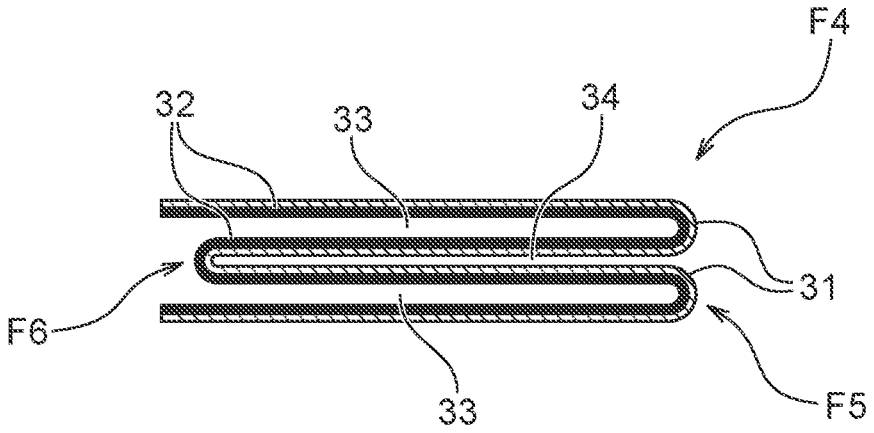
FIG. 7 is a diagram illustrating another example of the section of the raw material portion in the state in which the raw material portion is accommodated in the case.

FIG. 7 is a diagram illustrating another example of the section of the raw material portion 30 in the state in which the raw material portion 30 is accommodated in the case 20. The raw material portion 30 in the illustrated example includes three folding lines F4, F5, and F6. Specifically, the raw material portion 30 is folded along the folding line F4 and the folding line F5 such that the raw material layer 32 faces itself and is folded along the folding line F6 such that the base material layer 31 faces itself. The direction in which the raw material portion 30 illustrated in FIG. 7 is folded along the folding line F6 is opposite to that of the folding line F3 of the raw material portion 30 illustrated in FIG. 6. In this manner, the raw material portion 30 includes first clearances 33 formed by the raw material layer 32 facing itself and a second clearance 34 formed by the base material layer 31 facing itself. In other words, it is possible to form the first clearances 33 and the second clearance 34 without causing complete close contact of the sheet by folding the raw material portion 30 that is a sheet along the folding lines F4, F5, and F6. In the illustrated example, the raw material portion 30 includes a pair of first clearances 33, and the second clearance 34 is located between the pair of first clearances 33. In this manner, it is possible to substantially uniformly heat the raw material layer 32 located on both sides of the second clearance 34 with the heating blade 150*a* or the susceptor disposed at the second clearance 34, and as a result, it is possible to uniformize the aerosols generated from the pair of first clearances 33.

As illustrated in FIGS. 6 and 7, the raw material portion 30 includes the first clearances 33 formed by the raw material layer 32 facing itself, and it is thus possible to allow the aerosols generated from the raw material layer 32 to pass through the first clearances 33. In other words, the first clearances 33 can define air flow paths through which the aerosols pass. In this manner, it is possible to efficiently deliver the aerosols generated from the raw material layer 32 toward the downstream side. Also, since the raw material portion 30 includes the second clearance 34 formed by the base material layer 31 facing itself, it is possible to efficiently heat the raw material layer 32 without bringing the heating blade 150*a* or the susceptor into contact with the raw material layer 32 by inserting the heating blade 150*a* of the heating portion 150 or the susceptor of the flavor inhaler 100 into the second clearance 34. In this manner, contamination of the heating blade 150*a* or the susceptor with the raw material layer 32 is curbed, and it is possible to reduce a frequency of cleaning of the heating blade 150*a* or the susceptor.

The raw material portion 30 is not limited to the examples illustrated in FIGS. 6 and 7 and can include arbitrary folding lines. Also, the raw material portion 30 may not include any folding lines, and a flat raw material portion 30 may be disposed in the case 20. Note that in a case where the heating portion 150 of the flavor inhaler 100 includes the induction coil 150*b*, the metal layer 31*a* of the raw material portion 30 has the function of the susceptor. In other words, it is possible to heat the raw material layer 32 by the induction coil 150*b* induction-heating the metal layer 31*a*. In this case, the flavor inhaler 100 may not include the susceptor.

Figure 8:
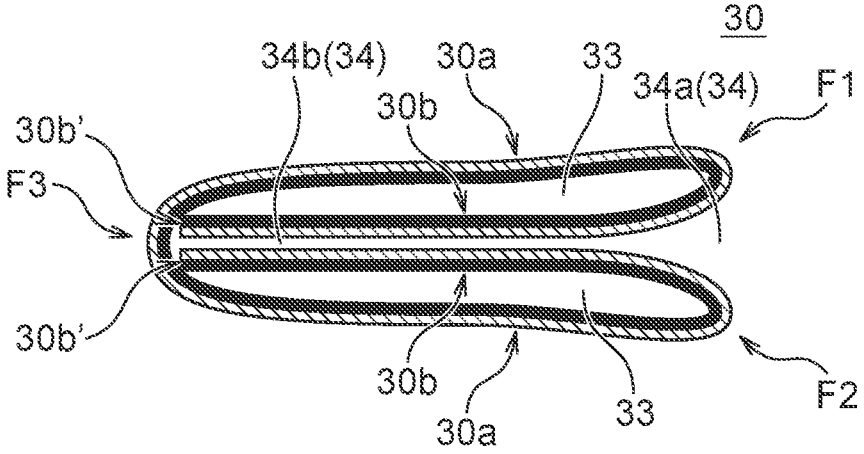
FIG. 8 is a diagram illustrating yet another example of the section of the raw material portion in a state in which the raw material portion is accommodated in the case.

FIG. 8 is a diagram illustrating yet another example of the section of the raw material portion 30 in the state in which the raw material portion 30 is accommodated in the case 20. The raw material portion 30 illustrated in FIG. 8 includes a pair of inner folded portions 30*b* that are folded along the folding line F1 and the folding line F2 and are located inside the raw material portion 30 and a pair of outer folded portions 30*a* that are folded along the folding line F3 and are located outside the raw material portion 30. Note that the folding line F3 is located between the folding line F1 and the folding line F2 in a state in which the raw material portion 30 is opened.

The raw material portion 30 illustrated in FIG. 8 includes the raw material portion 30 illustrated in FIG. 6, first clearances 33 that is formed by the raw material layer 32 facing itself using similar folding lines, and a second clearance 34 that is formed by the base material layer 31 facing itself. However, the raw material portion 30 illustrated in FIG. 8 is different from the raw material portion 30 illustrated in FIG. 6 in that a part of the second clearance 34 is larger than another part of the second clearance 34 in order to insert the heating blade 150*a* or the susceptor. Specifically, the size of a second clearance 34*a* between the folding line F1 and the folding line F2 is larger than the size of a second clearance 34*b* between end portions 30*b*' on the side opposite to the folding line F1 or the folding line F2 of the pair of inner folded portions 30*b* in the example illustrated in FIG. 8. In this manner, the heating blade 150*a* or the susceptor is easily inserted into the relatively large second clearance 34*a*. Therefore, it is possible to curb erroneous insertion of the heating blade 150*a* or the susceptor into the first clearance 33.

It is possible to set the size of the second clearance 34*a* between the folding line F1 and the folding line F2 to be larger than the size of the second clearance 34*b* between the end portions 30*b*' of the inner folded portions 30*b* as illustrated in FIG. 8 by adjusting the length of the inner folded portions 30*b*. Specifically, it is possible to set the length of the outer folded portions 30*a* (the length from the folding line F1 or the folding line F2 to the folding line F3 in the section illustrated in FIG. 8) to, for example, 10.5 mm and to set the length of the inner folded portions 30*b* (the length from the folding line F1 or the folding line F2 to the end portions 30*b*' on the opposite side in the section illustrated in FIG. 8) to, for example, 9.5 mm. In this case, when the raw material portion 30 is folded along the folding line F1, the folding line F2, and the folding line F3, the end portions 30*b*' of the inner folded portions 30*b* come into contact with the vicinity of the folding line F3 of the outer folded portions 30*a* as illustrated in the drawing. At this time, each of the inner folded portions 30*b* receives a stress directed toward the folding line F1 or the folding line F2 from the outer folded portions 30*a*. In this manner, each of the inner folded portion 30*b* is bent to be warped, the folding line F1 and the folding line F2 are separated from each other, and the size of the second clearance 34*a* between the folding line F1 and the folding line F2 increases.

Not limited thereto, and in a case in which the raw material portion 30 can maintain the shape through plastic deformation, for example, it is possible to bend the raw material portion 30 such that the size of the second clearance 34*a* between the folding line F1 and the folding line F2 to be larger than the size of the second clearance 34*b* between the end portions 30*b*' on the side opposite to the folding line F1 of the inner folded portions 30*b* by adjusting the force generated when the raw material portion 30 is bent. Note that the length of the raw material portion 30 illustrated in FIGS. 6 to 8 in the direction that is orthogonal to the insertion direction of the heating blade 150*a* (the length in the left-right direction in the drawing), that is, the width of the raw material portion 30 is preferably longer than the width of the heating blade 150*a*. Alternatively, the length of the length of the raw material portion 30 in the insertion direction of the heating blade 150*a* (the depth direction of the paper surface in the drawing) is preferably longer than the length of the heating blade 150*a*. In this manner, a part that does not come into contact with the heating blade 150*a* is generated in the raw material portion 30, the heating blade 150*a* can gradually heat the part of the raw material portion 30, and it is thus possible to curb a decrease in amount of production of aerosols in the later stage of the smoking action.

Although the raw material portion 30 illustrated in FIG. 8 is formed by a folding method that is similar to that of the raw material portion 30 illustrated in FIG. 6, the present invention is not limited thereto. The raw material portion 30 can have arbitrary folding lines such that the size of the second clearance 34*a* between the folding lines is larger than the size of the second clearance 34*b* between the end portions 30*b*' of the inner folded portions 30*b*.

Figure 9:
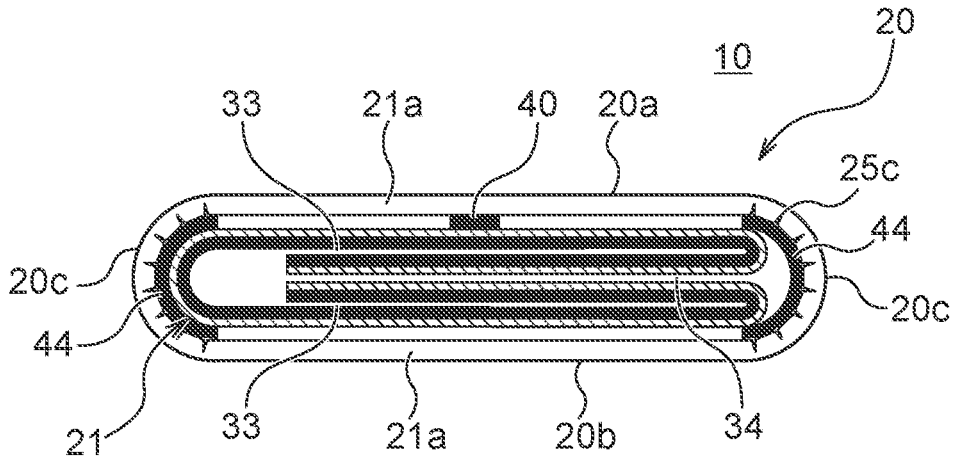
FIG. 9 is a side view of the cartridge seen from a first opening.

FIG. 9 is a side view of the cartridge 10 seen from the first opening 21. As illustrated in the drawing, the pair of connecting walls 20*c* of the case are formed into arc shapes, more specifically, circular arc shapes in a section seen from the first opening 21. Note that the terms "arc shape" or "circular arc shape" in the present specification include a substantially "arc shape" or "circular arc shape" and also include a case in which the connecting walls 20*c* have a corner that can be visually recognized. The connecting walls 20*c* include a plurality of half-cuts or debosses 25 on the inner surfaces thereof, that is, the surfaces facing the inside of the case 20. The half-cuts or debosses 25 extend between the first end surface 21*a* and the second end surface 22*a* of the case 20. The half-cuts or debosses 25 can be formed by cutting notches in the inner surfaces of the case 20, cutting parts of the inner surfaces, or compressing the inner surfaces. Also, the half-cuts or debosses 25 may be formed by laser processing. In other words, the half-cuts or debosses 25 can also be referred to as cut lines or indentation lines formed on the inner surfaces of the connecting walls 20*c*. The connecting walls 20*c* are folded along the half-cuts or debosses 25, and as a result, the connecting walls 20*c* are formed into arc shapes or circular arc shapes in the section seen from the first opening 21.

According to the cartridge 10 illustrated in FIG. 9, the material of the case 20 is easily folded along the half-cuts or debosses 25 when the connecting walls 20*c* of the case 20 are formed even if the case 20 is formed of a material having rigidity to some extent, for example, a cardboard, by the case 20 having the plurality of half-cuts or debosses 25. As a result, it is possible to appropriately bend the connecting walls 20*c* of the case 20. Also, the shape of the case 20 is easily maintained by the case 20 including the connecting walls 20*c*, as compared with a case in which the first wall 20*a* and the second wall 20*b* of the case 20 are connected with flat walls. Specifically, according to the case 20 in the present embodiment, the plurality of half-cuts or debosses 25 are deformed to collapse even if a force in a direction inclined with respect to the first wall 20*a* is applied to the case 20, for example, the inner surfaces of the connecting walls 20*c* defining the half-cuts or debosses 25 react against each other by coming into contact with each other, and the shape of the case 20 illustrated in FIG. 9 is thus easily maintained.

Also, since each of the pair of connecting walls 20*c* of the case 20 is formed into an arc shape in the section seen from the first opening 21, the stress applied to the connecting walls 20*c* is dispersed, and it is possible to improve the strength of the case 20 as compared with the case in which the first wall 20*a* and the second wall 20*b* are connected with flat walls. Also, the cartridge 10 is provided with air flow paths inside the case 20 as described above. Specifically, the first clearances 33 of the raw material portion 30 establish the air flow paths. Therefore, it is possible to curb closing of the air flow paths inside the case 20 by the shape of the case 20 being easily maintained.

The interval of the plurality of half-cuts or debosses 25 is preferably equal to or greater than 0.5 mm and equal to or less than 3.0 mm and is more preferably equal to or greater than 0.5 mm and equal to or less than 1.5 mm. Here, the interval of the plurality of half-cuts or debosses 25 means the distance between adjacent half-cuts or debosses 25 in the section illustrated in FIG. 9. If the interval of the plurality of half-cuts or debosses 25 is less than 0.5 mm, the excessively short interval may cause a difficulty in manufacturing. Also, if the interval of the plurality of half-cuts or debosses 25 is greater than 3.0 mm, it becomes necessary to increase the size of the case 20 itself to form the connecting walls 20*c*, and there is a likelihood that the size is not suitable as the size of the cartridge 10 of the flavor inhaler 100. Additionally, if the interval between the plurality of half-cuts or debosses 25 is equal to or less than 1.5 mm, it is possible to cause the shapes of the connecting walls 20*c* to approach circular arc shapes and to more appropriately disperse the stress applied to the case 20. Therefore, if the interval of the plurality of half-cuts or debosses 25 falls within the above range, it is possible to reliably form the plurality of half-cuts or debosses 25 and to form the connecting walls 20*c* with the size that is suitable as the size of the cartridge 10.

The depth of the plurality of half-cuts or debosses 25 is preferably equal to or greater than 30% and equal to or less than 90% and is more preferably equal to or greater than 50% and equal to or less than 80% of the thickness of the connecting walls 20*c*. If the depth of the plurality of half-cuts or debosses 25 is less than 30% of the thickness of the connecting walls 20*c*, it is difficult to bend and fold the material forming the case 20, and it may be difficult to appropriately form the connecting walls 20*c*. Also, if the depth of the plurality of half-cuts or debosses 25 is greater than 90% of the thickness of the connecting walls 20*c*, there is a concern that the strength of the case 20 itself is excessively degraded. Therefore, if the depth of the plurality of half-cuts or debosses 25 falls within the above range, it is possible to appropriately form the connecting walls 20*c* and also to maintain the strength of the case 20 itself.

Although the connecting walls 20*c* are formed into arc shapes by providing the plurality of half-cuts or debosses 25 in the case 20 illustrated in FIG. 9, the present invention is not limited thereto, and the connecting walls 20*c* may have arbitrary folding lines (corner portions). For example, the case 20 can have a substantially hexagonal section by the connecting walls 20*c* including a half-cut or a deboss 25 at a boundary of each of the first wall 20*a* and the second wall

20*b* and another half-cut or deboss 25. It is possible to cause the shapes of the sections of the connecting walls 20*c* to approach the arc shapes by increasing the number of half-cuts or debosses 25.

The angle of the inner wall surface that are adjacent with the half-cuts or debosses 25 regarded as boundaries when the half-cuts or debosses 25 are formed in the inner surfaces of the connecting walls 20*c* is preferably greater than 90 degrees and less than 180 degrees and is more preferably equal to or greater than 100 degrees and equal to or less than 150 degrees. In a case in which the section of the case 20 has a quadrangular shape, for example, a part where the angle of the wall surfaces that are adjacent with the half-cuts or debosses 25 regarded as boundaries is equal to or less than 90 degrees occurs. Even if the half-cuts or debosses 25 are formed when the case 20 is formed of a cardboard with sufficient rigidity, it is difficult to maintain the shape of the case 20 due to a strong repulsive force of the cardboard due to folding of the case 20 at an angle of equal to or less than 90 degrees. If the case 20 is formed of a cardboard that has low rigidity to such an extent that the shape of the case 20 can be maintained, the strength of the case 20 is degraded. If the above angle is equal to or greater than 100 degrees and equal to or less than 150 degrees, it is possible to cause the sectional shapes of the connecting walls 20*c* to be substantially arc shapes.

The plurality of half-cuts or debosses 25 are preferably provided over not less than 50% of the length between the first end surface 21*a* and the second end surface 22*a* of the case 20. If the plurality of half-cuts or debosses 25 are provided over less than 50% of the length between the first end surface 21*a* and the second end surface 22*a* of the case 20, the effect of facilitating formation of the connecting walls 20*c* when the material forming the case 20 is folded is low. Therefore, if the length of the plurality of half-cuts or debosses 25 is equal to or greater than the above numerical value, it is possible to easily bend the connecting walls 20*c* along the plurality of half-cuts or debosses 25.

Also, as illustrated in the drawing, the cartridge 10 may include an adhesive 44 provided on the plurality of half-cuts or debosses 25. In this manner, it is possible to maintain the curved shapes of the connecting walls 20*c* with the adhesive 44 and thereby to more firmly maintain the shape of the case 20. Also, the adhesive 44 may be configured to establish adhesin between the case 20 and the raw material portion 30 as illustrated in FIG. 9. In this case, it is possible to maintain the curved shapes of the connecting walls 20*c* and to curb deviation of the raw material portion 30 with respect to the case 20 with the adhesive 44. As the adhesive 44, it is possible to use, for example, a vinyl acetate resin-based adhesive or a carboxy methyl cellulose (CMC) adhesive.

Also, as illustrated in the drawing, the case 20 and the raw material portion 30 can be bonded with an adhesive 40. Specifically, the inner surface of the case 20 and at least a part of the raw material portion 30 are bonded with the adhesive 40. In this manner, positional deviation of the raw material portion 30 with respect to the case 20 is curbed when the heating blade 150*a* or the susceptor is inserted into the second clearance 34 of the raw material portion 30. As the adhesive 40, it is possible to use, for example, a vinyl acetate resin-based adhesive or a carboxy methyl cellulose (CMC) adhesive.

As illustrated in FIG. 9, the first opening 21 exposes at least the first clearances 33 of the raw material portion 30. In the example illustrated in FIG. 9, the first opening 21 exposes the first clearances 33 and the second clearance 34 of the raw material portion 30. The aerosols generated from the raw material portion 30 can reach the inside of the user's mouth from the first opening 21 through the first clearances 33 by the first opening 21 exposing the first clearances 33. Also, although not illustrated in FIG. 9, the second opening 22 exposes at least the second clearance 34 of the raw material portion 30. The second opening 22 exposes the first clearances 33 and the second clearance 34 of the raw material portion 30 similarly to the example illustrated in FIG. 9. In the present embodiment, it is possible to insert the heating blade 150*a* or the susceptor into the second opening 22 by the second opening 22 exposing the second clearance 34.

Figure 10:
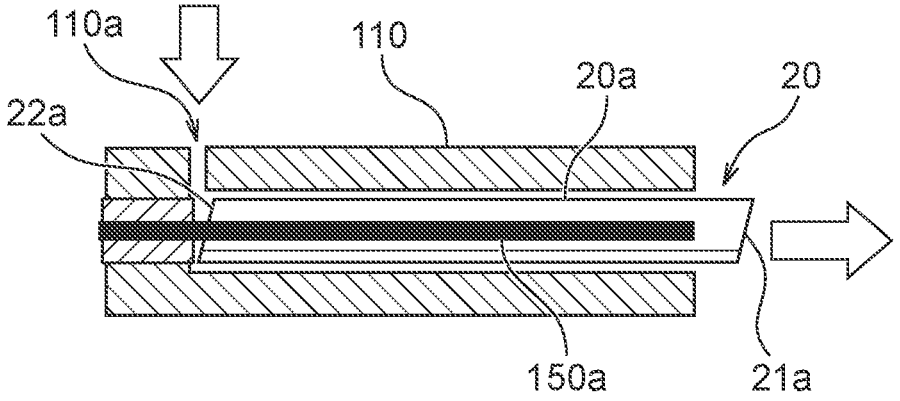
FIG. 10 is a schematic side sectional view illustrating a cartridge according to another embodiment.

FIG. 10 is a schematic side sectional view illustrating a cartridge 10 according to another embodiment. FIG. 10 illustrates a state in which a heating blade 150*a* of a flavor inhaler 100 is inserted into the cartridge 10. In the example illustrated in FIG. 10, the flavor inhaler 100 includes one heating blade 150*a*, and a vent hole 110*a* is provided in a side surface of a first housing 110. As illustrated in the drawing, a second end surface 22*a* of a case 20 is formed to be inclined with respect to a first wall 20*a*. It is thus possible to secure a flow path of air flowing into the cartridge 10 from the vent hole 110*a* formed in the side surface of the first housing 110.

Figure 11:
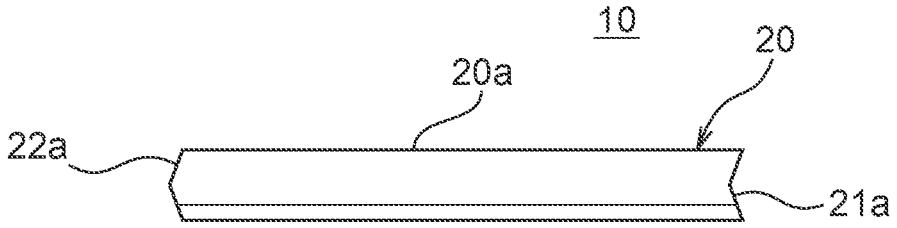
FIG. 11 is a schematic side view illustrating a cartridge according to another embodiment.

FIG. 11 is a schematic side view illustrating a cartridge 10 according to another embodiment. As illustrated in FIG. 11, a second end surface 22*a* of a case 20 is formed to be inclined with respect to a first wall 20*a*. Specifically, the second end surface 22*a* of the case 20 has a wedge shape in the illustrated example. It is thus possible to secure a flow path of air flowing into the cartridge 10 from a vent hole 110*a* formed in a side surface of a housing 110.

Note that in the example in FIG. 10, the first end surface 21*a* of the case 20 is also inclined with respect to the first wall 20*a*. Also, in the example in FIG. 11, the first end surface 21*a* of the case 20 has the shape that matches the second end surface 22*a*. This is because the second end surface 22*a* of the cartridge 10 (case 20) and the first end surface 21*a* of another cartridge 10 are formed at the same time by cutting a raw material 10' (see FIG. 14) of the cartridge 10, which will be described later. In FIGS. 10 and 11, the first end surface 21*a* may perpendicularly intersect the first wall 20*a*.

Figure 12A:
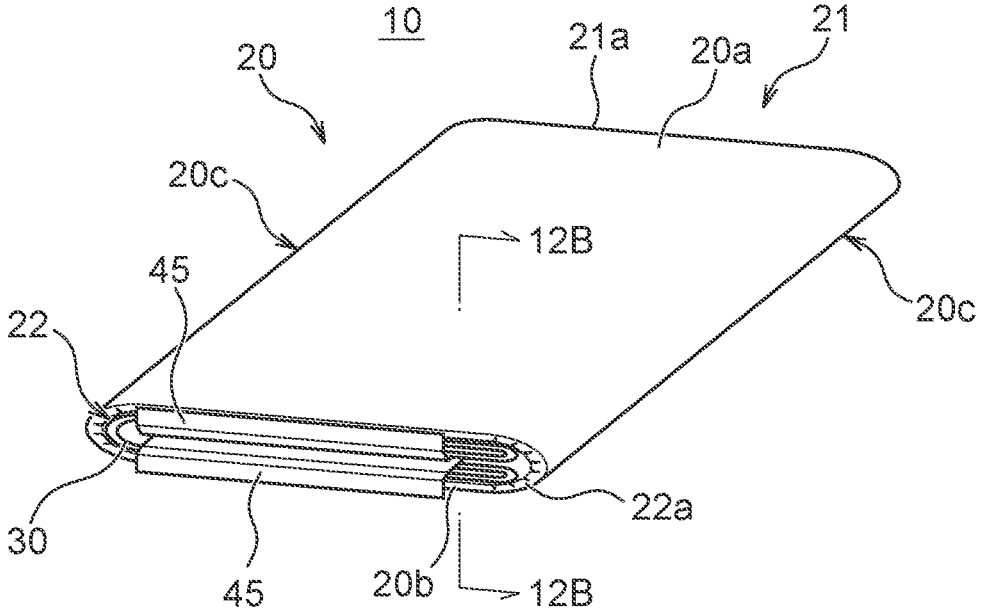
FIG. 12A is a perspective view illustrating a cartridge according to another embodiment.
Figure 12B:
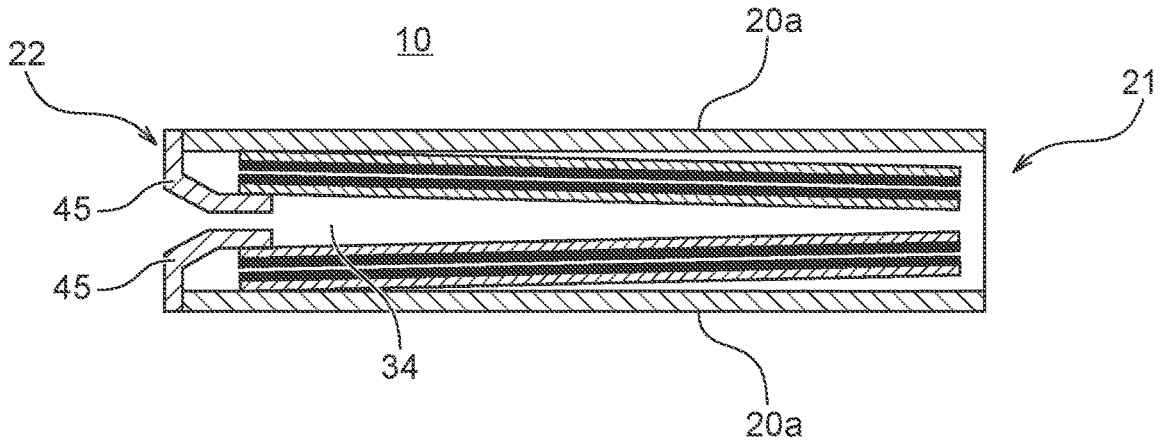
FIG. 12B is a schematic sectional view along the arrow 12B-12B illustrated in FIG. 12A.

FIG. 12A is a perspective view illustrating a cartridge 10 according to another embodiment. FIG. 12B is a schematic sectional view along the arrow 12B-12B illustrated in FIG. 12A. As illustrated in FIGS. 12A and 12B, a case 20 of the cartridge 10 includes guide portions 45 extending between a second end surface 22*a* forming a second opening 22 and a second clearance 34 of a raw material portion 30. In the illustrated example, the case 20 includes a pair of guide portions 45, and each of the guide portions 45 extends between the second end surface 22*a* on the side of the first wall 20*a* of the case 20 and the second clearance 34. In this manner, a heating blade 150*a* or a susceptor is guided to the second clearance 34 by the guide portions 45 when the heating blade 150*a* or the susceptor is inserted from the second opening 22, and it is possible to curb erroneous insertion thereof into first clearances 33.

Although the example described above has been described on the assumption that the raw material portion 30 includes the base material layer 31 and the raw material layer 32, the present invention is not limited thereto, and the raw material portion 30 may not include the base material layer 31. In other words, the raw material portion 30 may be configured only of the raw material layer 32. In this case, the raw material portion 30 can be the aforementioned tobacco sheet or non-tobacco sheet. The raw material portion 30 can be folded along the folding lines that are similar to those in the case in which the base material layer 31 is included. However, since the raw material portion 30 does not include the base material layer 31 in this case, the second clearance 34 where the base material layer 31 faces itself is not formed. On the other hand, the first clearances 33 can be formed without causing complete close contact of the sheet using the repulsive force caused by elastic deformation due to folding of the raw material layer 32, by folding the raw material portion 30 along the folding lines F1, F2, and F3 or the folding lines F4, F5, and F6.

Figure 13:
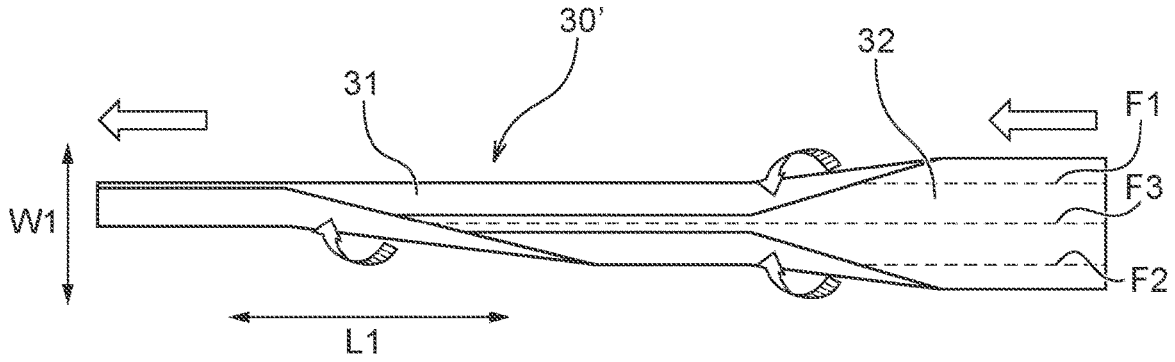
FIG. 13 is a diagram illustrating a process for manufacturing the raw material portion illustrated in FIG. 6.
Figure 14:
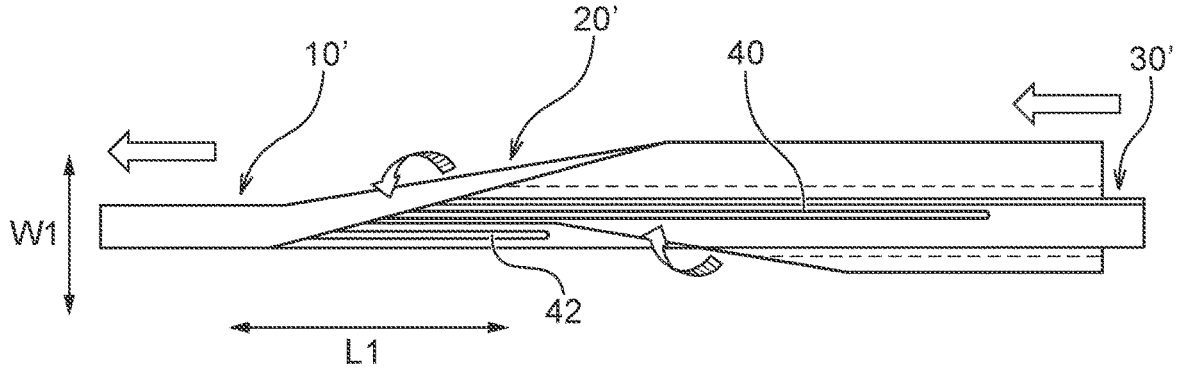
FIG. 14 is a diagram illustrating a process for manufacturing the cartridge illustrated in FIG. 9.

Next, a method for manufacturing the cartridge 10 will be described. FIG. 13 is a diagram illustrating a process for manufacturing the raw material portion 30 illustrated in FIG. 6. FIG. 14 is a diagram illustrating a process for manufacturing the cartridge 10 illustrated in FIG. 9. In FIGS. 13 and 14, the length direction L1 and the width direction W1 are additionally illustrated. As illustrated in FIG. 13, a sheet 30' constituting the raw material portion 30 is transported to one side of the length direction L1 (the left direction in the drawing) in a state in which the base material layer 31 is suctioned to a suctioning conveyor, for example. The sheet 30' is folded inward along the folding line F1 and the folding line F2 first while being transported, and the raw material layer 32 thereby faces itself. Subsequently, the sheet 30' is folded inward along the folding line F2, and the base material layer 31 thereby faces itself.

Next, the folded sheet 30' is disposed on a sheet 20' for a case as illustrated in FIG. 14. The sheet 20' for a case is transported to one side (the left direction in the drawing) of the length direction L1 in a state in which the sheet 20' for a case is suctioned to a suctioning conveyor, for example. The adhesive 40 is applied to the sheet 30' along the length direction L1 while the sheet 20' for a case and the sheet 30' is transported. Subsequently, one side (the lower side in the drawing) of the sheet 20' for a case in the width direction W1 is folded while forming the connecting walls 20*c* illustrated in FIGS. 4 and 9 so as to surround the sheet 30', and the adhesive 42 is applied thereto along the length direction L1 of the folded sheet 20' for a case. Moreover, the other side (the upper side in the drawing) of the sheet 20' for a case in the width direction W1 is folded while forming the connecting walls 20*c* illustrated in FIGS. 4 and 9 so as to surround the sheet 30', end portions of the sheet 20' for a case in the width direction W1 are bonded via the adhesive 42, and the sheet 20' for a case and the folded sheet 30' are bonded via the adhesive 40. In this manner, the raw material 10' of the cartridge 10 is manufactured. The cartridge 10 is manufactured by the raw material 10' being cut into a predetermined length with a round knife, for example. Note that it is possible to manufacture the cartridge 10 illustrated in FIGS. 10 and 11 by adjusting the angle of the cutting and the number of times the cutting is performed using the round knife or the like at this time. As the adhesive 42, it is possible to use, for example, a vinyl acetate resin-based adhesive or a carboxy methyl cellulose (CMC) adhesive.

Figure 15:
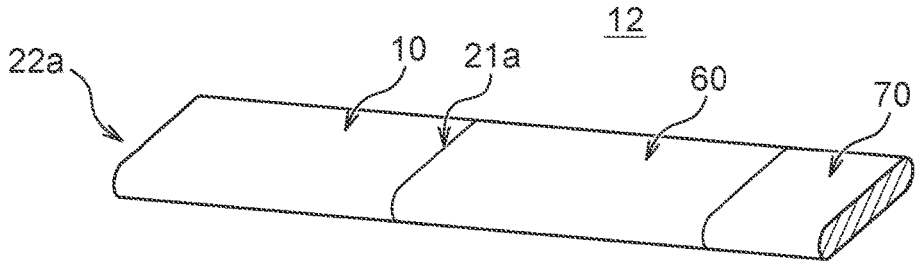
FIG. 15 is a schematic perspective view illustrating a cartridge according to another embodiment.

FIG. 15 is a schematic perspective view illustrating a cartridge according to another embodiment. A cartridge 12 illustrated in FIG. 15 includes any of the cartridges 10 illustrated in FIGS. 4, 10, 11, 12A, and 12B, a cooling portion 60, and a mouthpiece portion 70. The cooling portion 60 is configured to cool aerosols generated from the raw material portion 30 of the cartridge 10. Specifically, the cooling portion 60 can be a tube made of paper or a tube made of a metal attached paper such as an aluminum attached paper, for example. In a case in which the cooling portion 60 is configured of a metal attached paper, the cooling portion 60 is preferably formed into a tubular shape such that an aluminum surface is located inside the cooling portion 60. Also, the cooling portion 60 has a thin tubular shape in accordance with the shape of the cartridge 10 as illustrated in the drawing. Therefore, since the area in which vapor or aerosols passing through the cooling portion 60 come into contact with the inner surface of the cooling portion 60 increases as compared with a case where the cooling portion 60 is a cylinder, it is possible to improve cooling efficiency. One or more materials selected from a group consisting of polyethylene, polypropylene, polyvinyl chloride, polyethylene terephthalate, polylactic acid, cellulose acetate, and aluminum foil may be disposed in or may fill the cooling portion 60. It is possible to more efficiently cool the aerosols by these materials being disposed in or filling the cooling portion 60. Note that the cooling portion 60 may be provided with a vent hole for taking air from the outside. It is possible to improve cooling efficiency by the cooling portion 60 taking air from the outside. The length of the cooling portion 60 can be equal to or greater than 20 mm and equal to or less than 50 mm, for example. Note that the vent hole is preferably provided near the cartridge 10 in the cooling portion 60 since a higher cooling effect is achieved as the vent hole is closer to the cartridge 10 (that is, the raw material portion 30). Also, the amount of external air to be taken from the vent hole to the cooling portion 60 is preferably equal to or greater than 10% and equal to or less than 80% and is more preferably equal to or greater than 20% and equal to or less than 50% of mainstream smoke.

The mouthpiece portion 70 is configured such that aerosols generated by the raw material portion 30 pass therethrough. In the illustrated example, the aerosols passing through the cooling portion 60 are supplied to the user through the mouthpiece portion 70. The mouthpiece portion 70 can have a length to such an extent that the user can hold the mouthpiece portion 70 in his/her mouth. The mouthpiece portion 70 may be a hollow tubular member or may be provided with a filter such as an acetate filter or a charcoal filter therein. Alternatively, the mouthpiece portion 70 may be a thin non-woven fabric or the like. The length of the mouthpiece portion 70 can be equal to or greater than 5 mm and equal to or less than 25 mm, for example. Also, a part of the cooling portion 60 may be used as the mouthpiece portion 70 by extending the length of the cooling portion 60.

The cooling portion 60 is disposed in the first end surface 21*a* of the cartridge 10 (case 20). The mouthpiece portion 70 is disposed on the side opposite to the side of the cartridge 10 of the cooling portion 60. The cartridge 12 can be formed by the cartridge 10, the cooling portion 60, and the mouthpiece portion 70 being connected to each other with a tipping paper, for example, in a state in which they are aligned as illustrated in the drawing.

Figure 16:
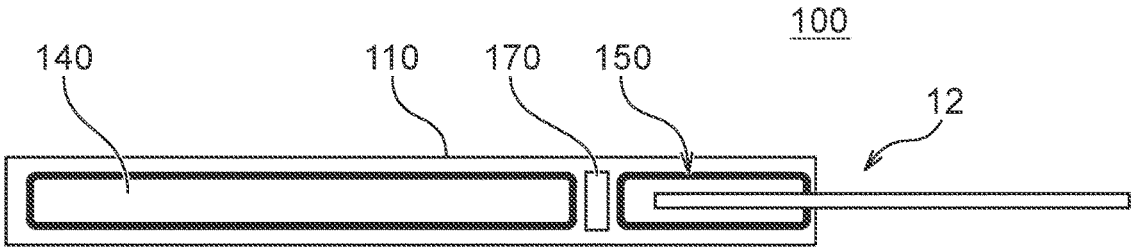
FIG. 16 is a schematic sectional view illustrating a flavor inhaler according to another embodiment.

FIG. 16 is a schematic sectional view illustrating a flavor inhaler 100 according to another embodiment. As illustrated in the drawing, the flavor inhaler 100 does not include a second housing 120, a cooling portion 160, and a mouthpiece 130 as compared with the flavor inhaler 100 illustrated in FIG. 2. An end portion of a first housing 110 of the flavor inhaler 100 on the side of a heating portion 150 is opened and is configured such that the cartridge 12 illustrated in FIG. 15 can be inserted into the heating portion 150. The heating portion 150 may include a heating blade 150*a* or may include an induction coil 150*b*.

In the flavor inhaler 100 illustrated in FIG. 16, the cartridge 10 of the cartridge 12 is inserted into the heating portion 150. Aerosols are generated by the raw material portion 30 of the cartridge 10 being heated by the heating portion 150, and the user can inhale the aerosols via the mouthpiece portion 70 of the cartridge 12. In the illustrated example, since the cartridge 12 including the cooling portion 60 and the mouthpiece portion 70 is used, and the flavor inhaler 100 may not include the second housing 120, the cooling portion 160, and the mouthpiece 130. Therefore, since contamination does not adhere to the second housing 120, the cooling portion 160, and the mouthpiece 130, it is possible to further reduce adhesion of contamination to the flavor inhaler 100.

Figure 17:
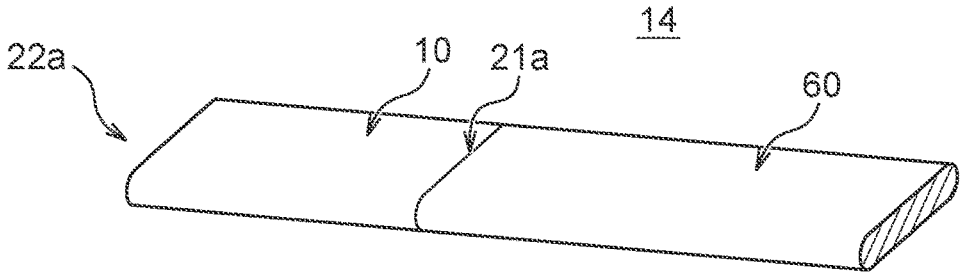
FIG. 17 is a schematic perspective view illustrating a cartridge according to another embodiment.

FIG. 17 is a schematic perspective view illustrating a cartridge according to another embodiment. A cartridge 14 illustrated in FIG. 17 includes any of the cartridges 10 illustrated in FIGS. 4, 10, 11, 12A, and 12B and a cooling portion 60. In other words, the cartridge 14 illustrated in FIG. 17 does not include a mouthpiece portion 70 as compared with the cartridge 12 illustrated in FIG. 15.

Figure 18:
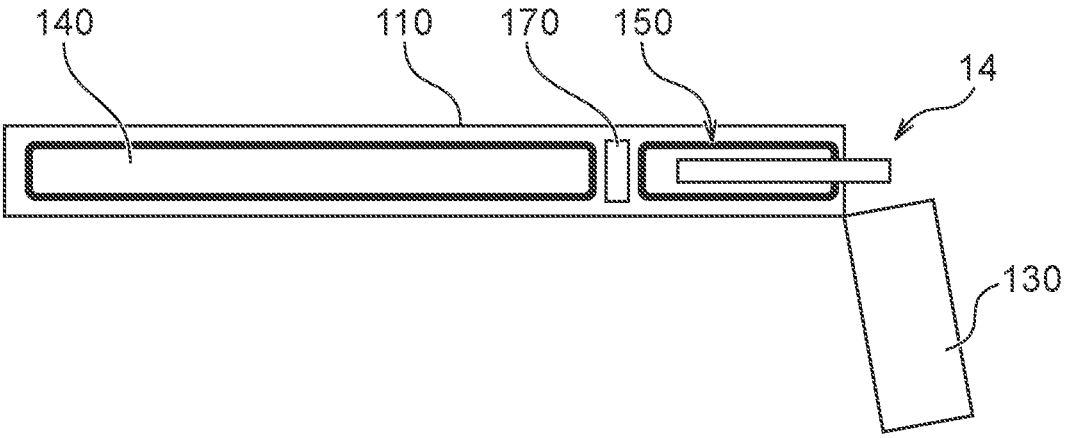
FIG. 18 is a schematic sectional view illustrating a flavor inhaler according to another embodiment.

FIG. 18 is a schematic sectional view illustrating a flavor inhaler 100 according to another embodiment. As illustrated in the drawing, the flavor inhaler 100 does not include a second housing 120 and a cooling portion 160 as compared with the flavor inhaler 100 illustrated in FIG. 2. In other words, the flavor inhaler 100 illustrated in FIG. 18 is different from the flavor inhaler 100 illustrated in FIG. 16 in that the flavor inhaler 100 illustrated in FIG. 18 includes a mouthpiece 130. An end portion of a first housing 110 of the flavor inhaler 100 on the side of a heating portion 150 is opened and is configured such that the cartridge 12 illustrated in FIG. 17 can be inserted into the heating portion 150. The heating portion 150 may include a heating blade 150*a* or may include an induction coil 150*b*.

In the flavor inhaler 100 illustrated in FIG. 18, the cartridge 10 of the cartridge 14 is inserted into the heating portion 150. Aerosols are generated by the raw material portion 30 of the cartridge 10 being heated by the heating portion 150, and the user can inhale the aerosols via the cooling portion 60 of the cartridge 14 and the mouthpiece 130 of the flavor inhaler 100.

Figure 19:
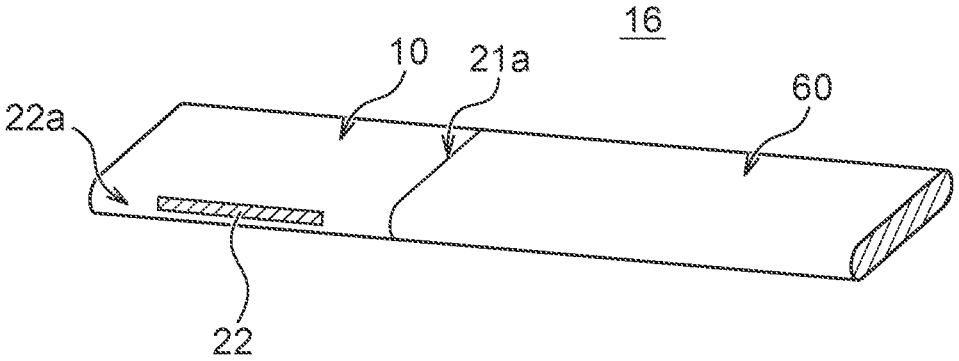
FIG. 19 is a schematic perspective view illustrating a cartridge according to another embodiment.

FIG. 19 is a schematic perspective view illustrating a cartridge according to another embodiment. A cartridge 16 illustrated in FIG. 19 is different from the cartridge 14 illustrated in FIG. 17 in that connecting walls 20*c* are provided with a third opening 23. The cartridge 16 can be heated by inserting a heating blade 150*a* or a susceptor from the third opening 23 of the cartridge 16. Note that the cartridge 16 may not include a cooling portion 60 and may be configured only of the cartridge 10. Also, the cartridge 10 may include a second opening 22, or a second end surface 22*a* may be closed.

In the cartridges 12, 14, and 16 described in FIGS. 15, 17, and 19, the case 20 may be caused to serve as an external layer of the cooling portion 60 and/or the mouthpiece portion 70 by extending the length of the case 20 of the cartridge 10. In this case, the length of the case 20 of the cartridge 10 illustrated in FIG. 15 (the length between the first end surface 21*a* and the second end surface 22*a*), for example, is preferably equal to or greater than 50 mm and equal to or less than 100 mm. Also, the length of the case 20 of the cartridge 10 illustrated in FIGS. 17 and 19 (the length between the first end surface 21*a* and the second end surface 22*a*) is preferably equal to or greater than 25 mm and equal to or less than 95 mm. For example, a hollow part of the case 20, a part where a metal attached paper such as an aluminum attached paper is attached to the inner surface of the case 20, a part in which the aforementioned material for cooling the aerosols is disposed or a part filled with the aforementioned material, or the like can be used as the cooling portion 60. Also, the hollow part of the case 20 or a part where a filter is provided may be used as the mouthpiece portion 70. As described above, since the case 20 includes the half-cuts or debosses 25, the shape of the case 20 is easily maintained even if the length of the case 20 is extended.

Figure 20:
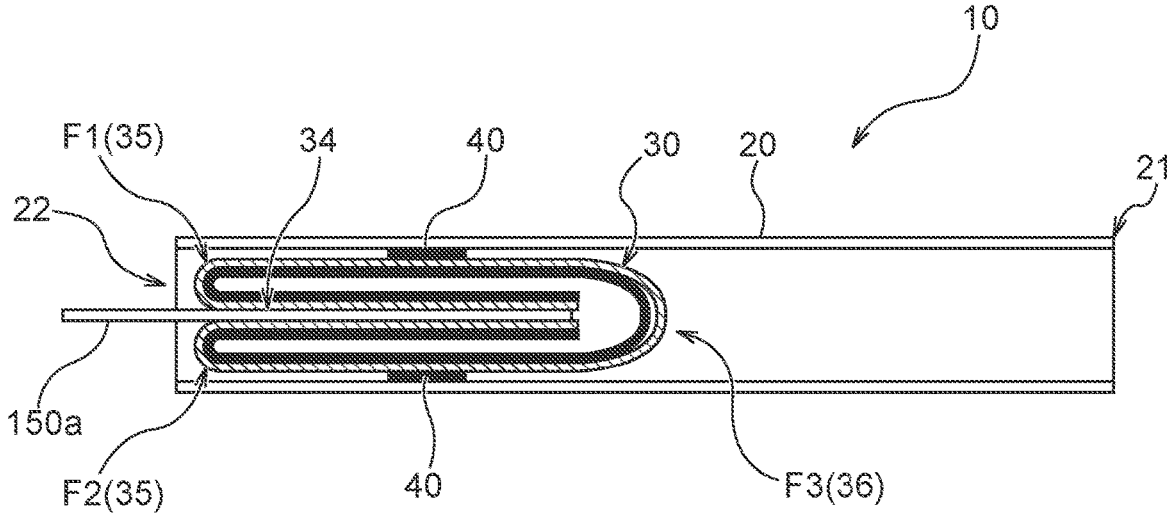
FIG. 20 is a schematic sectional view illustrating a cartridge according to another embodiment.

FIG. 20 is a schematic sectional view illustrating a cartridge 10 according to another embodiment. As illustrated in FIG. 20, a raw material portion 30 of the cartridge 10 is folded along three folding lines F1, F2, and F3 that are similar to those of the raw material portion 30 illustrated in FIG. 6. Here, the raw material portion 30 includes a first end portion 35 where the folding line F1 or the folding line F2 is located and a second end portion 36 on a side opposite to the first end portion 35. In the illustrated example, the folding line F3 is located at the second end portion 36. A second clearance 34 extends from the first end portion 35. Specifically, the second clearance 34 extends from the first end portion 35 toward the second end portion 36 as illustrated in FIG. 20. In the illustrated example, a heating blade 150*a* is inserted into the second clearance 34.

The cartridge 10 illustrated in FIG. 20 is different from the cartridge 10 illustrated in FIG. 4 in the direction of the raw material portion 30. Specifically, in the cartridge 10 illustrated in FIG. 20, the raw material portion 30 is disposed inside the case 20 such that the first end portion 35 faces the second opening 22 (second end surface 22*a*) of the case 20. In other words, the raw material portion 30 is disposed inside the case 20 such that the distance between the first end portion 35 of the raw material portion 30 and the second opening 22 (second end surface 22*a*) of the case 20 is shorter than the distance between the second end portion 36 and the second opening 22 (second end surface 22*a*). In this manner, the second clearance 34 is exposed to the second opening 22. Therefore, when the heating blade 150*a* or the susceptor of the heating portion 150 is inserted from the second opening 22 as illustrated in the drawing, the heating portion 150 is easily inserted into the second clearance 34 where the base material layer 31 faces itself. In this case, it is possible to efficiently heat the raw material layer 32 without bringing the heating blade 150*a* or the susceptor into contact with the raw material layer 32 by heating the raw material portion 30 with the heating blade 150*a*, the susceptor, or the like disposed in the second clearance 34. In this manner, contamination of the heating blade 150*a* or the susceptor with the raw material layer 32 is curbed, and it is possible to reduce a frequency of cleaning of the heating blade 150*a* or the susceptor. Also, vapor or aerosols generated from the raw material layer 32 can pass through the second clearance 33 where the raw material layer 32 faces itself. In this manner, it is possible to efficiently deliver the vapor or the aerosols generated from the raw material layer 32 toward the downstream side. Note that although the raw material portion 30 illustrated in FIG. 6 is accommodated in the case 20 in the example illustrated in FIG. 20, the raw material portion 30 illustrated in FIG. 7 or 8 may be accommodated in the case 20 in a direction similar to the direction illustrated in FIG. 20.

Figure 21A:
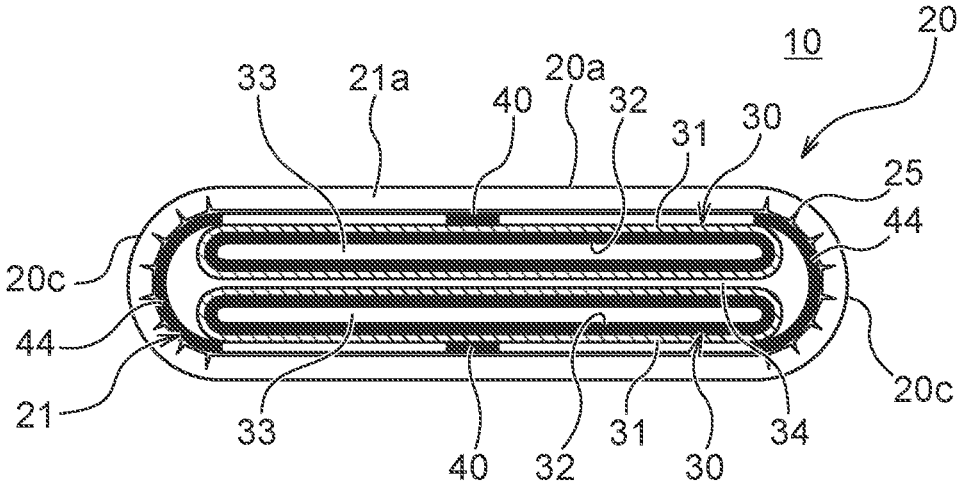
FIG. 21A is a schematic side view illustrating a cartridge according to another embodiment.

FIG. 21A is a schematic side view illustrating a cartridge 10 according to another embodiment. FIG. 21A illustrates a side surface of the cartridge 10 seen from a first opening 21. The cartridge 10 illustrated in FIG. 21A is different from the cartridge 10 illustrated in FIG. 4 in that a plurality of raw material portion 30 are accommodated in a case 20. Specifically, the cartridge 10 illustrated in FIG. 21A includes two raw material portions 30. In the illustrated example, each of the raw material portions 30 can include a sheet in which a base material layer 31 and a raw material layer 32 are laminated and can be formed into a tubular shape such that the raw material layer 32 is located inward. Also, the raw material portions 30 are disposed to face each other in the thickness direction. As a result, the cartridge 10 includes a second clearance 34 formed by base material layers 31 of the raw material portions 30 facing each other. Additionally, each of the raw material portions 30 includes a first clearance 33 where the raw material layer 32 face itself therein. Each of the raw material portions 30 is preferably bonded to the inner surface of the case 20 via the adhesive 40.

Figure 21B:
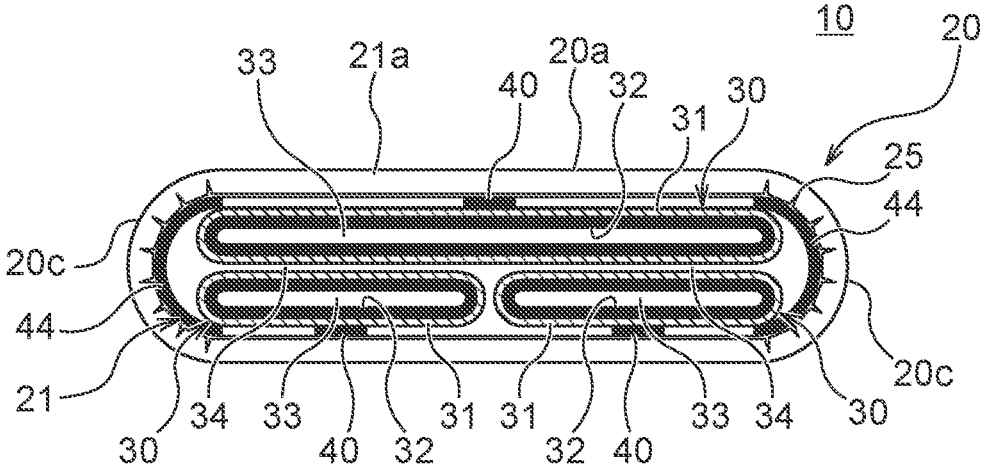
FIG. 21B is a schematic side view illustrating a cartridge according to another embodiment.

FIG. 21B is a schematic side view illustrating a cartridge 10 according to another embodiment. FIG. 21B illustrates a side view of the cartridge 10 seen from a first opening 21. The cartridge 10 illustrated in FIG. 21B is different from the cartridge 10 illustrated in FIG. 21A in that the cartridge 10 illustrated in FIG. 21B includes three raw material portions 30. In the illustrated example, each of the raw material portions 30 can include a sheet in which a base material layer 31 and a raw material layer 32 are laminated and can be formed into a tubular shape in which the raw material layer 32 is located inward. Also, two raw material portions 30 out of the three raw material portions 30 are disposed to be adjacent to each other in the width direction, and the remaining one raw material portion 30 is disposed to face the two raw material portions 30, which are adjacent to each other in the width direction, in the thickness direction. As a result, the cartridge 10 includes a second clearance 34 formed by each of the base material layers 31 of the two raw material portions 30 that are adjacent to each other in the width direction and the base material layer 31 of the remaining one raw material portion 30 facing each other. Each of the raw material portion 30 is preferably bonded to the inner surface of the case 20 via the adhesive 40.

According to the cartridge 10 illustrated in FIGS. 21A and 21B, since the plurality of raw material portions 30 are included, it is also possible to employ raw material portions 30 with different raw material layers 32. Although the raw material portions 30 are formed into tubular shapes in the cartridge 10 illustrated in FIGS. 21A and 21B, the present invention is not limited thereto, and the raw material portions 30 may be sheets that are simply folded such that the raw material layers 32 face each other rather than the tubular shape. Also, in the cartridge 10 illustrated in FIGS. 21A and 21B, the direction of the raw material portions 30 may be changed to the direction in the cartridge 10 illustrated in FIG. 20. In other words, although the raw material portions 30 are disposed such that the axial direction of the tubular raw material portions 30 is directed to the second opening 22 (second end surface 22*a*) in the cartridge 10 illustrated in FIGS. 21A and 21B, the raw material portions 30 may be disposed such that the radial direction of the tubular raw material portions 30 is directed to the second opening 22 (second end surface 22*a*).

Although the examples described in FIGS. 20, 21A, and 21B have been described on the assumption that the raw material portions 30 have the base material layers 31 and the raw material layers 32, the present invention is not limited thereto, and the raw material portions 30 may not include the base material layers 31. In other words, the raw material portions 30 may be configured only of the raw material layers 32. In this case, the raw material portions 30 can be the aforementioned tobacco sheets or non-tobacco sheets.

Although the heating blade 150*a* or the susceptor is inserted into the second clearance 34 and heats the cartridge 10 in the embodiments described above, the present invention is not limited thereto, and the raw material portion 30 may be heated from one surface side by moving the heating blade 150*a* or the susceptor to the side surface of the raw material portion 30. In this case, the heat is gradually transmitted from the one surface side of the raw material portion 30, and it is possible to extend the smoking time.

Although the embodiments of the present invention have been described hitherto, the present invention is not limited to the above embodiments, and various modifications can be made within the scope of the technical idea described in the claims, the specification, and the drawings. Note that any shapes and materials that are not directly illustrated in the specification and the drawing are also within the scope of the technical idea of the invention of the present application as long as the effects and the advantages of the invention of the present applications can be achieved.

Some aspects disclosed in the present specification will be described below.

According to a first aspect, there is provided a flavor inhaler cartridge. The cartridge includes: a raw material portion that is heated and thereby generates aerosols; and a case that accommodates the raw material portion therein. The case includes a first wall, a second wall that faces the first wall, a pair of connecting walls that connect the first wall to the second wall, a first end surface that is provided with a first opening defined by the first wall, the second wall, and the pair of connecting walls, and a second end surface that faces the first end surface portion. The pair of connecting walls include, on surfaces facing inside of the case, a plurality of half-cuts or debosses extending between the first end surface and the second end surface, and are folded along the plurality of half-cuts or debosses.

According to the first aspect, since the inner surfaces of the connecting walls of the case include the plurality of half-cuts or debosses, the case material is easily folded along the half-cuts or the debosses when the connecting walls of the case are formed even if the case is formed of a material having rigidity to some extent, such as a cardboard, for example. As a result, it is possible to appropriately fold the connecting walls of the case. Also, the first wall and the second wall are connected with the pair of connecting walls including the half-cuts or the debosses. In this manner, the shape of the case is easily maintained even if a force in a direction inclined with respect to the first wall is applied to the case, by the plurality of half-cuts or debosses being deformed to collapse and by the inner surfaces of the connecting walls that define the half-cuts or the debosses coming into contact with each other.

According to a gist of a second aspect, in the first aspect, the case includes an air flow path, through which the aerosols pass, therein.

According to the second aspect, the shape of the case is easily maintained even if a force in a direction inclined with respect to the first wall is applied to the case, and it is thus possible to curb closing of the air flow path inside the case.

According to a gist of a third aspect, in the first aspect or the second aspect, the connecting walls are formed into arc shapes in a section seen from the first opening.

According to the third aspect, the connecting walls have arc-shaped sections, a stress applied to the connecting walls is thus dispersed, and it is possible to improve strength of the case as compared with a case where the first wall and the second wall are connected with flat walls.

According to a gist of a fourth aspect, in any of the first aspect to the third aspect, an interval of the plurality of half-cuts or debosses is equal to or greater than 0.5 mm and equal to or less than 3.0 mm.

The interval of the plurality of half-cuts or debosses means the distance between adjacent half-cuts or debosses. If the interval of the plurality of half-cuts or debosses is less than 0.5 mm, the excessively short interval may cause a difficulty in manufacturing. Also, if the interval of the plurality of half-cuts or debosses is greater than 3.0 mm, it becomes necessary to increase the size of the case itself to form the connecting walls, and there may be a likelihood that the size is not suitable as a size of a flavor inhaler cartridge. According to the fourth aspect, it is possible to reliably form the plurality of half-cuts or debosses and to form the connecting walls with a size that is suitable as a size of a flavor inhaler cartridge.

According to a gist of a fifth aspect, in any of the first aspect to the fourth aspect, a depth of the plurality of half-cuts or debosses is equal to or greater than 30% and equal to or less than 90% of a thickness of the connecting walls.

If the depth of the plurality of half-cuts or debosses is less than 30% of the thickness of the connecting walls, it is difficult to bend and fold the material forming the case, and it may be difficult to appropriately form the connecting walls. Also, if the depth of the plurality of half-cuts or debosses is greater than 90% of the thickness of the connecting walls, there is a concern that the strength of the case itself is excessively degraded. According to the fifth aspect, it is possible to appropriately form the connecting walls and to maintain the strength of the case itself.

According to a sixth aspect, in any of the first aspect to the fifth aspect, an angle of inner wall surfaces of the connecting walls that are adjacent with the plurality of half-cuts or debosses regarded as boundaries is greater than 90 degrees and less than 180 degrees.

In a case in which the section of the case has a quadrangular shape, for example, a part where the angle of the wall surfaces that are adjacent with the half-cuts or the debosses regarded as boundaries is equal to or less than 90 degrees occurs. Even if the half-cuts or the debosses are formed when the case is formed of a cardboard with sufficient rigidity, a repulsive force of the cardboard caused by the case being folded to an angle of equal to or less than 90 degrees is strong, and it is thus difficult to maintain the shape of the case. If the case is formed of a cardboard having low rigidity to such an extent that the shape of the case can be maintained, the strength of the case is degraded. According to the sixth aspect, it is possible to maintain the shape of the case even if the case is formed of a cardboard with sufficient rigidity.

According to a gist of a seventh aspect, in any of the first aspect to the sixth aspect, the plurality of half-cuts or debosses are provided over not less than 50% of a length between the first end surface and the second end surface of the case.

If the plurality of half-cuts or debosses are provided over less than 50% of the length between the first end surface and the second end surface of the case, an effect of facilitating formation of the connecting walls when the material forming the case is folded is low. According to the seventh aspect, it is possible to easily bend the connecting walls along the plurality of half-cuts or debosses.

According to a gist of an eighth aspect, in any of the first aspect to the seventh aspect, an adhesive that is provided on the plurality of half-cuts or debosses is included.

According to the eighth aspect, it is possible to maintain the curved shape of the connecting walls with the adhesive and thereby to more firmly maintain the shape of the case.

According to a gist of a ninth aspect, in the eighth aspect, the adhesive is configured to establish adhesion between the case and the raw material portion.

According to the ninth aspect, it is possible to maintain the curved shape of the connecting walls and to curb deviation of the raw material portion with respect to the case with the adhesive.

According to a gist of a tenth aspect, in any of the first aspect to the ninth aspect, the raw material portion includes a sheet including a raw material layer, and the cartridge includes a first clearance formed by the raw material layer of the sheet facing itself.

According to the tenth aspect, the first clearance defines the air flow path, and it is thus possible to allow the aerosols generated from the raw material layer to pass through the first clearance. In this manner, it is possible to efficiently deliver the aerosols generated from the raw material layer toward the downstream side.

According to a gist of an eleventh aspect, in the tenth aspect, the sheet of the raw material portion includes a base material layer laminated on the raw material layer, and the cartridge includes a second clearance formed by the base material layer facing itself.

According to the eleventh aspect, the cartridge includes the second clearance, and it is thus possible to efficiently heat the raw material layer without bringing a heating blade or a susceptor of the flavor inhaler into contact with the raw material layer, by inserting the heating blade or the susceptor into the second clearance. In this manner, contamination of the heating blade or the susceptor with the raw material layer is curbed, and it is thus possible to reduce a frequency of cleaning of the heating blade or the susceptor.

According to a gist of a twelfth aspect, in the eleventh aspect, a part of the second clearance is larger than another part of the second clearance.

According to the twelfth aspect, a part including a large clearance is formed at a part of the second clearance, and the heating blade or the susceptor is thus easily inserted into the relatively large part of the second clearance. Therefore, it is possible to curb erroneous insertion of the heating blade or the susceptor into the first clearance.

According to a gist of a thirteenth aspect, in the twelfth aspect, the raw material portion includes a pair of inner folded portions that are folded along a first folding line and a second folding line and are located inside the raw material portion and a pair of outer folded portions that are folded along a third folding line located between the first folding line and the second folding line and are located outside the raw material portion, and a size of the second clearance between the first folding line and the second folding line is larger than a size of the second clearance between end portions on a side opposite to the first folding line or the second folding line of the pair of inner folded portions.

According to the thirteenth aspect, the relatively large second clearance is formed between the first folding line and the second folding line, and the heating blade or the susceptor is thus easily inserted into the relatively large part of the second clearance. Therefore, it is possible to curb erroneous insertion of the heating blade or the susceptor into the first clearance.

According to a gist of a fourteenth aspect, in any of the first aspect to the thirteenth aspect, the raw material layer includes a non-tobacco sheet including an aerosol source.

According to a fifteenth aspect, there is provided a flavor inhaler. The flavor inhaler includes: a heating portion that is configured to heat the raw material portion of the flavor inhaler cartridge according to any of the first aspect to the twelfth aspect; and a battery that is configured to supply electric power to the heating portion.

REFERENCE SIGNS LIST

10, 12, 14, 16 Cartridge
20 Case
20*a* First wall
20*b* Second wall
20*c* Connecting wall
21 First opening
21*a* First end surface
22*a* Second end surface
25 Half-cut or deboss
30 Raw material portion
30' Sheet
30*a* Outer folded portion
30*b* Inner folded portion
30*b'* End portion
31 Base material layer
32 Raw material layer
33 First clearance
34, 34*a*, 34*b* Second clearance
44 Adhesive
45 Guide portion
60 Cooling portion
70 Mouthpiece portion
100 Flavor inhaler
130 Mouthpiece
140 Battery
150 Heating portion
160 Cooling portion
F1, F2, F3, F4, F5, F6 Folding line

The invention claimed is:

1. A flavor inhaler cartridge comprising:
a raw material portion that is heated and thereby generates aerosols; and
a case that accommodates the raw material portion therein,
wherein the case includes
a first wall,
a second wall that faces the first wall,
a pair of connecting walls that connect the first wall to the second wall,
a first end surface that is provided with a first opening defined by the first wall, the second wall, and the pair of connecting walls, and
a second end surface that faces the first end surface, and
the pair of connecting walls include, on surfaces facing inside of the case, a plurality of half-cuts or debosses extending between the first end surface and the second end surface, and are folded along the plurality of half-cuts or debosses,
wherein the connecting walls are formed into arc shapes extending along an entire length of the respective connecting wall in a section seen from the first opening.

2. The flavor inhaler cartridge according to claim 1, wherein the case includes an air flow path, through which the aerosols pass, therein.

3. The flavor inhaler cartridge according to claim 1, wherein an interval of the plurality of half-cuts or debosses is equal to or greater than 0.5 mm and equal to or less than 3.0 mm.

4. The flavor inhaler cartridge according to claim 1, wherein a depth of the plurality of half-cuts or debosses is equal to or greater than 30% and equal to or less than 90% of a thickness of the connecting walls.

5. The flavor inhaler cartridge according to claim 1, wherein an angle of inner wall surfaces of the connecting walls that are adjacent with the plurality of half-cuts or debosses regarded as boundaries is greater than 90 degrees and less than 180 degrees.

6. The flavor inhaler cartridge according to claim 1, wherein the plurality of half-cuts or debosses are provided over not less than 50% of a length between the first end surface and the second end surface of the case.

7. The flavor inhaler cartridge according to claim 1, further comprising:
an adhesive that is provided on the plurality of half-cuts or debosses.

8. The flavor inhaler cartridge according to claim 7, wherein the adhesive is configured to establish adhesion between the case and the raw material portion.

9. The flavor inhaler cartridge according to claim 1,
wherein the raw material portion includes a sheet including a raw material layer, and
the cartridge includes a first clearance formed by the raw material layer of the sheet facing itself.

10. The flavor inhaler cartridge according to claim 9,
wherein the sheet of the raw material portion includes a base material layer laminated on the raw material layer, and
the cartridge includes a second clearance formed by the base material layer facing itself.

11. The flavor inhaler cartridge according to claim 10, wherein a part of the second clearance is larger than another part of the second clearance.

12. The flavor inhaler cartridge according to claim 11,
wherein the raw material portion includes a pair of inner folded portions that are folded along a first folding line and a second folding line and are located inside the raw material portion and a pair of outer folded portions that are folded along a third folding line located between the first folding line and the second folding line and are located outside the raw material portion, and
a size of the second clearance between the first folding line and the second folding line is larger than a size of the second clearance between end portions on a side opposite to the first folding line or the second folding line of the pair of inner folded portions.

13. The flavor inhaler cartridge according to claim 1, wherein the raw material layer includes a non-tobacco sheet including an aerosol source.

14. A flavor inhaler comprising:
a heating portion that is configured to heat the raw material portion of the flavor inhaler cartridge according to claim 1; and
a battery that is configured to supply electric power to the heating portion.

15. The flavor inhaler cartridge according to claim 1, wherein the connecting walls each have a continuously arcuate profile extending from the first wall to the second wall.

* * * * *